US011444372B2

(12) United States Patent
Sayama

(10) Patent No.: US 11,444,372 B2
(45) Date of Patent: Sep. 13, 2022

(54) ANTENNA, ANTENNA-ATTACHED DEVICE, AND ANTENNA-ATTACHED WINDOW GLASS FOR VEHICLE

(71) Applicant: AGC Inc., Tokyo (JP)

(72) Inventor: Toshiki Sayama, Tokyo (JP)

(73) Assignee: AGC INC., Tokyo (JP)

( * ) Notice: Subject to any disclaimer, the term of this patent is extended or adjusted under 35 U.S.C. 154(b) by 19 days.

(21) Appl. No.: 16/822,234

(22) Filed: Mar. 18, 2020

(65) Prior Publication Data

US 2020/0220254 A1 Jul. 9, 2020

Related U.S. Application Data

(63) Continuation of application No. PCT/JP2018/037094, filed on Oct. 3, 2018.

(30) Foreign Application Priority Data

Oct. 10, 2017 (JP) ..... JP2017-197272

(51) Int. Cl.
*H01Q 1/12* (2006.01)
*H01Q 1/32* (2006.01)
*H01Q 7/00* (2006.01)

(52) U.S. Cl.
CPC ..... *H01Q 1/3291* (2013.01); *H01Q 1/1285* (2013.01); *H01Q 7/00* (2013.01)

(58) Field of Classification Search
CPC ..... H01Q 1/3291; H01Q 1/1285; H01Q 7/00; H01Q 1/241; H01Q 1/2291; H01Q 9/26; H01Q 5/392; H01Q 5/371; H01Q 1/1271
See application file for complete search history.

(56) References Cited

U.S. PATENT DOCUMENTS

2004/0135726 A1 7/2004 Shamir et al.
2008/0048867 A1* 2/2008 Oliver ..... H01Q 7/00 340/572.7

(Continued)

FOREIGN PATENT DOCUMENTS

JP 2004-527974 A 9/2004
JP 2008-061115 A 3/2008

(Continued)

OTHER PUBLICATIONS

International Searching Authority, "International Search Report," issued in connection with International Patent Application No. PCT/JP2018/037094, dated Dec. 25, 2018.

(Continued)

*Primary Examiner* — Hai V Tran
*Assistant Examiner* — Michael M Bouizza
(74) *Attorney, Agent, or Firm* — Foley & Lardner LLP

(57) ABSTRACT

An antenna includes a first feeding portion, a second feeding portion, and a loop element including a first end and a second end, the first end being connected to the first feeding portion, and the second end being connected to the second feeding portion, wherein the loop element has a first element portion and a second element portion, which appear to face each other in a vertical direction in an elevation view as seen in a direction parallel with a horizontal plane, and wherein a first gap is provided in a middle of the first element portion, and a second gap is provided in a middle of the second element portion.

20 Claims, 14 Drawing Sheets

(56) References Cited

U.S. PATENT DOCUMENTS

| | | | |
|---|---|---|---|
| 2009/0146902 | A1 | 6/2009 | Li et al. |
| 2012/0206239 | A1 | 8/2012 | Ikemoto |
| 2016/0118708 | A1 | 4/2016 | Suenaga et al. |

FOREIGN PATENT DOCUMENTS

| | | | |
|---|---|---|---|
| JP | 2010-041256 | A | 2/2010 |
| JP | 2011-151624 | A | 8/2011 |
| JP | 2015-080072 | A | 4/2015 |
| WO | WO-2007/084510 | A1 | 7/2007 |
| WO | WO-2011/118379 | A1 | 9/2011 |

OTHER PUBLICATIONS

International Searching Authority, "Written Opinion," issued in connection with International Patent Application No. PCT/JP2018/037094, dated Dec. 25, 2018.

* cited by examiner

ANTENNA, ANTENNA-ATTACHED DEVICE, AND ANTENNA-ATTACHED WINDOW GLASS FOR VEHICLE

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2018/037094 filed on Oct. 3, 2018 and designating the U.S., which claims priority to Japanese Patent Application No. 2017-197272 filed on Oct. 10, 2017. The entire contents of the foregoing applications are incorporated herein by reference.

BACKGROUND OF THE INVENTION

1. Field of the Invention

The present invention relates to an antenna, an antenna-attached device, and an antenna-attached window glass for a vehicle.

2. Description of the Related Art

Conventionally, an in-vehicle circularly polarized antenna with loop-shaped linear conductors for receiving circularly polarized electromagnetic waves used by GPS (Global Positioning System) and ETC (Electronic Toll Collection system) is known (for example, see Japanese Laid-Open Patent Publication No. 2015-080072).

SUMMARY OF THE INVENTION

Problems to be Solved by the Invention

However, a high-speed communication system such as a telematics service, in which information is transmitted and received between a communication device installed on a vehicle and an outside of the vehicle, uses an antenna that can attain impedance matching over a wider frequency range than that of GPS or ETC. In the telematics service, antennas that can transmit and receive vertically polarized electromagnetic waves are used. For this reason, it has been difficult for conventional loop-shaped antennas to meet such requirements.

Therefore, it is desired to implement an antenna that can attain impedance matching over a wide frequency range and can transmit and receive vertically polarized electromagnetic waves.

Means for Solving the Problems

According to an aspect of the present disclosure, provided is an antenna including a first feeding portion, a second feeding portion, and a loop element including a first end and a second end, the first end being connected to the first feeding portion, and the second end being connected to the second feeding portion, wherein the loop element has a first element portion and a second element portion, which appear to face each other in a vertical direction in an elevation view as seen in a direction parallel with a horizontal plane, and wherein a first gap is provided in a middle of the first element portion, and a second gap is provided in a middle of the second element portion. Also, an antenna-attached device having the antenna and an antenna-attached window glass for a vehicle having the antenna are provided.

Advantageous Effects of the Invention

According to an aspect of the present disclosure, impedance matching can be attained over a wide frequency range, and vertically polarized electromagnetic waves can be transmitted and received.

BRIEF DESCRIPTION OF THE DRAWINGS

Other objects and further features of an embodiment will become apparent from the following detailed description when read in conjunction with the accompanying drawings, in which.

DETAILED DESCRIPTION OF THE PREFERRED EMBODIMENTS

Hereinafter, an embodiment for carrying out the present invention will be described with reference to the drawings. In each embodiment, deviations from directions such as parallel direction, perpendicular direction, orthogonal direction, horizontal direction, vertical direction, height direction, width direction, and the like are tolerated to such an extent that the effects of the present invention are not impaired.

An example of a window glass to which the present invention can be applied includes a windshield attached to a front portion of a vehicle. It should be noted that the window glass may be rear glass attached to a rear portion of a vehicle, or may be a side glass attached to a side portion of a vehicle.

A direction parallel with an X axis (X axis direction), a direction parallel with a Y axis (Y axis direction), and a direction parallel with a Z axis (Z axis direction) represent a width direction of a glass plate, a height direction of the glass plate, and a direction perpendicular to the surface of the glass plate (also referred to as a normal direction), respectively, when the glass plate alone is viewed as opposed to a surface of the glass plate. The X axis direction, the Y axis direction, and the Z axis direction are orthogonal to each other.

Figure 1:
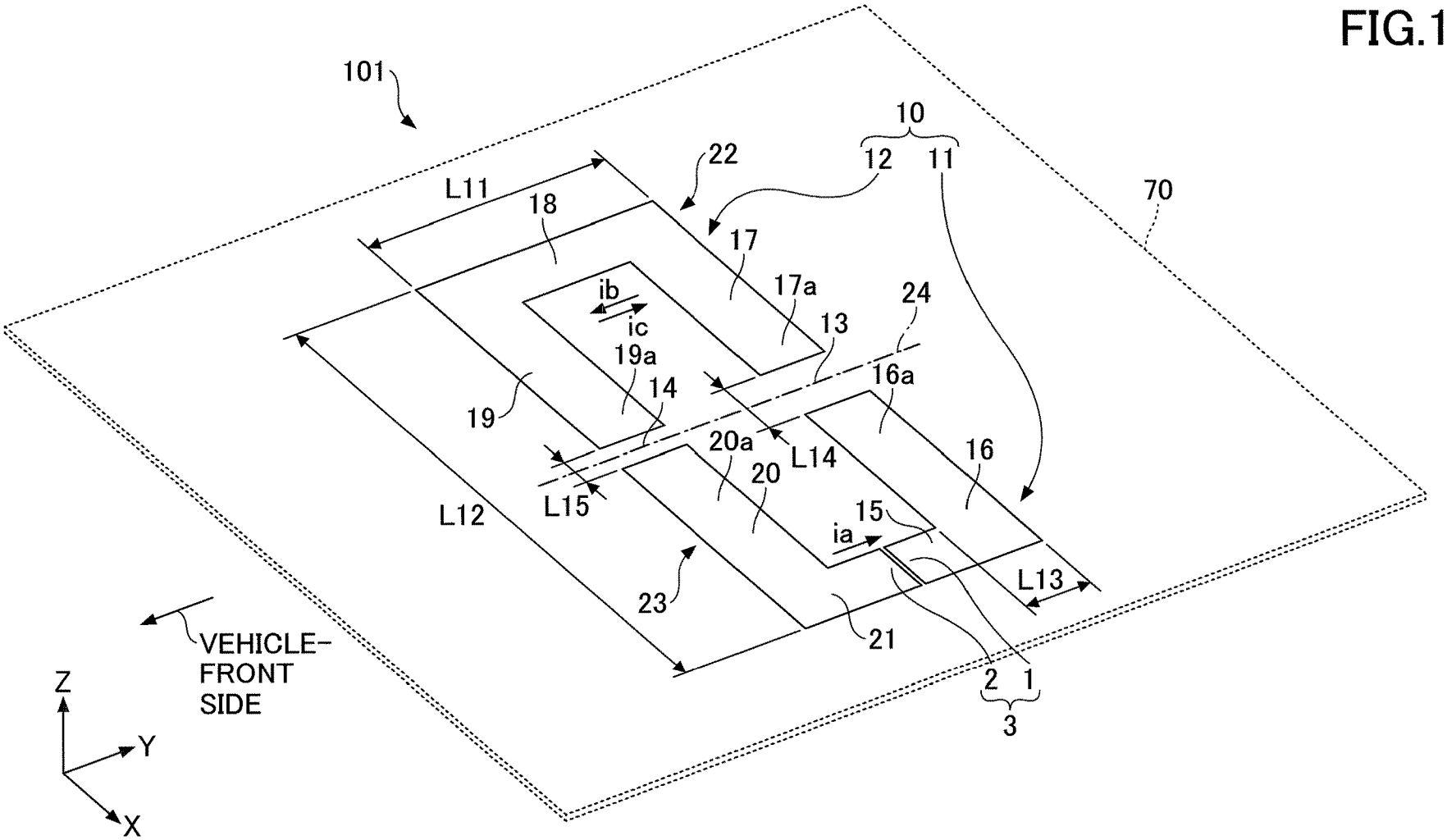
FIG. 1 is a perspective view illustrating a first configuration example of an antenna and an antenna-attached window glass for a vehicle.

FIG. 1 is a perspective view illustrating a first configuration example of an antenna and an antenna-attached window glass for a vehicle as viewed from a viewpoint at a vehicle-outer side. An antenna 101 is directly attached to a glass plate 70 or indirectly attached to the glass plate 70 with an attachment member, not illustrated. The glass plate 70 is an example of a glass plate for a vehicle-use window.

In the perspective view of FIG. 1, the glass plate 70 is indicated by a dotted line for convenience in order to increase the visibility of the shape of the antenna 101. Since FIG. 1 is a perspective view illustrated from a viewpoint at a vehicle-outer side, the antenna 101 is arranged in a negative direction of the Z axis (i.e., vehicle-inner side) with respect to the glass plate 70. In FIG. 1, the external shape of the glass plate 70 is simplified into a rectangular-like shape for convenience. The same applies to other perspective views described later.

The antenna 101 is a loop antenna including a feeding portion 3 and a loop element 10 connected to the feeding portion 3.

The feeding portion 3 is a feeding point for feeding power to the loop element 10. One end of a coaxial cable is directly connected to the feeding portion 3 or indirectly connected to the feeding portion 3 by a connector. The second end of the coaxial cable is connected to a device having at least one of, for example, a transmission function and a reception function.

The feeding portion 3 includes a first feeding portion 1 and a second feeding portion 2. The second feeding portion 2 is arranged with a gap from the first feeding portion 1. One of the first feeding portion 1 and the second feeding portion 2 is connected to a core of the coaxial cable, and the other of the first feeding portion 1 and the second feeding portion 2 is connected to an outer conductor of the coaxial cable.

The loop element 10 is a conductor formed in a loop shape having a first end and a second end. The first end of the loop shape is connected to the first feeding portion 1. The second end of the loop shape is connected to the second feeding portion 2. In the loop element 10, a first gap 13 and a second gap 14 are provided in intermediate sections of the loop shape between the first feeding portion 1 and the second feeding portion 2.

The loop element 10 includes a first antenna conductor 11 formed in a U-shape as viewed in the Z axis direction and a second antenna conductor 12 formed in a U-shape as viewed in the Z axis direction. The first gap 13 and the second gap 14 are present between the first antenna conductor 11 and the second antenna conductor 12. The first antenna conductor 11 and the second antenna conductor 12 may be separated by a distance which allows capacitive coupling via the first gap 13 and the second gap 14. As viewed from a viewpoint in the Z axis direction, the external contour of the U-shape may be a straight line or a curved line. In addition, as viewed in the Z axis direction, a corner portion of the U-shape is not limited to a right angle but may be formed at an angle other than the right angle, or may be rounded in a curved shape.

The first antenna conductor 11 is a feeding conductor connected to the feeding portion 3, whereas the second antenna conductor 12 is a non-feeding conductor not connected to the feeding portion 3 in terms of a direct current. The second antenna conductor 12 is fed from the first antenna conductor 11 via the first gap 13 and the second gap 14.

The first antenna conductor 11 includes segments 15, 16, 20, and 21. The second antenna conductor 12 includes segments 17, 18, and 19.

The segment 15 is a conductor portion extending in the Y axis direction. The segment 15 has a first end and a second end. The first end of the segment 15 is connected to the first feeding portion 1. The second end of the segment 15 is connected to a first end of the segment 16. The segment 16 is a conductor portion extending in the X axis direction. The segment 16 has the first end and a second end 16*a*. The first end of the segment 16 is connected to the second end of the segment 15. The second end 16*a* faces a first end 17*a* of the segment 17 via the first gap 13 in the X axis direction.

The segment 17 is a conductor portion extending in the X axis direction. The segment 17 has the first end 17*a* and a second end. The first end 17*a* faces the second end 16*a* of the segment 16 via the first gap 13 in the X axis direction. The second end of the segment 17 is connected to a first end of the segment 18. The segment 18 is a conductor portion extending in the Y axis direction. The segment 18 has the first end and a second end. The first end of the segment 18 is connected to the second end of the segment 17. The second end of the segment 18 is connected to a first end of the segment 19. The segment 19 is a conductor portion extending in the X axis direction. The segment 19 has the first end and a second end 19*a*. The first end of the segment 19 is connected to the second end of the segment 18. The second end 19*a* faces a first end 20*a* of the segment 20 via the second gap 14 in the X axis direction.

The segment 20 is a conductor portion extending in the X axis direction. The segment 20 has the first end 20*a* and a second end. The first end 20*a* faces the second end 19*a* of the segment 19 via the second gap 14 in the X axis direction. The second end of the segment 20 is connected to a first end of the segment 21. The segment 21 is a conductor portion extending in the Y axis direction. The segment 21 has the first end and a second end. The first end of the segment 21 is connected to the second end of the segment 20. The second end of the segment 21 is connected to the second feeding portion 2.

The loop element 10 has a first element portion 22 and a second element portion 23 that face each other in the Y axis direction. The first element portion 22 is formed by segments 16 and 17. The second element portion 23 is formed by segments 19 and 20. In the illustrated embodiment, the first element portion 22 and the second element portion 23 are on the same virtual plane.

In the middle of the first element portion 22, the first gap 13 is provided. The middle portion where the first gap 13 is provided is located between the first end of the segment 16 (i.e., the end to which the segment 15 is connected) and the second end of the segment 17 (i.e., the end to which the segment 18 is connected). In the illustrated embodiment, the first gap 13 is provided at a center position between the first end of the segment 16 and the second end of the segment 17.

In the middle of the second element portion 23, the second gap 14 is provided. The middle portion where the second gap 14 is provided is located between the first end of the segment 19 (i.e., the end to which the segment 18 is connected) and the second end of the segment 20 (i.e., the end to which the segment 21 is connected). In the illustrated embodiment, the second gap 14 is provided at the center position between the first end of the segment 19 and the second end of the segment 20.

Thus, in the antenna 101 illustrated in FIG. 1, the loop element 10 is provided so that the first gap 13 and the second gap 14 are inserted in the intermediate sections of the loop shape between the first feeding portion 1 and the second feeding portion 2. In the illustrated embodiment, the first gap 13 is provided in the longitudinal direction of the first element portion 22 in the middle of the first element portion 22. The second gap 14 is provided in the longitudinal direction of the second element portion 23 in the middle of the second element portion 23.

Since the first gap 13 and the second gap 14 are provided in this manner, the loop element 10 resonates with multiple resonances by two resonance modes in which the resonance frequencies are different. Further, the antenna 101 which can attain good impedance matching over a wide frequency range can be achieved with multiple resonances of the loop element 10.

When the loop element 10 resonates in a first resonance mode, the loop element 10 operates in a reverse phase mode in which a current ia flowing through the first antenna conductor 11 and a current ib flowing through the second antenna conductor 12 are in opposite directions. When the loop element 10 resonates in a second resonance mode, of which the resonance frequency is different from the resonance frequency of the first resonance mode, the loop element 10 operates in a same phase mode in which the current ia flowing through the first antenna conductor 11 and a current ic flowing through the second antenna conductor 12 are in the same direction.

The current ia represents a current flowing through the first antenna conductor 11 from the first end 20*a* of the segment 20 to the second end 16*a* of the segment 16 via the feeding portion 3. The current ib represents a current flowing through the second antenna conductor 12 from the first end 17*a* of the segment 17 through the segment 18 to the second end 19*a* of the segment 19. The current ic represents a current flowing through the second antenna conductor 12 from the second end 19*a* of the segment 19 through the segment 18 to the first end 17*a* of the segment 17.

Figure 7:
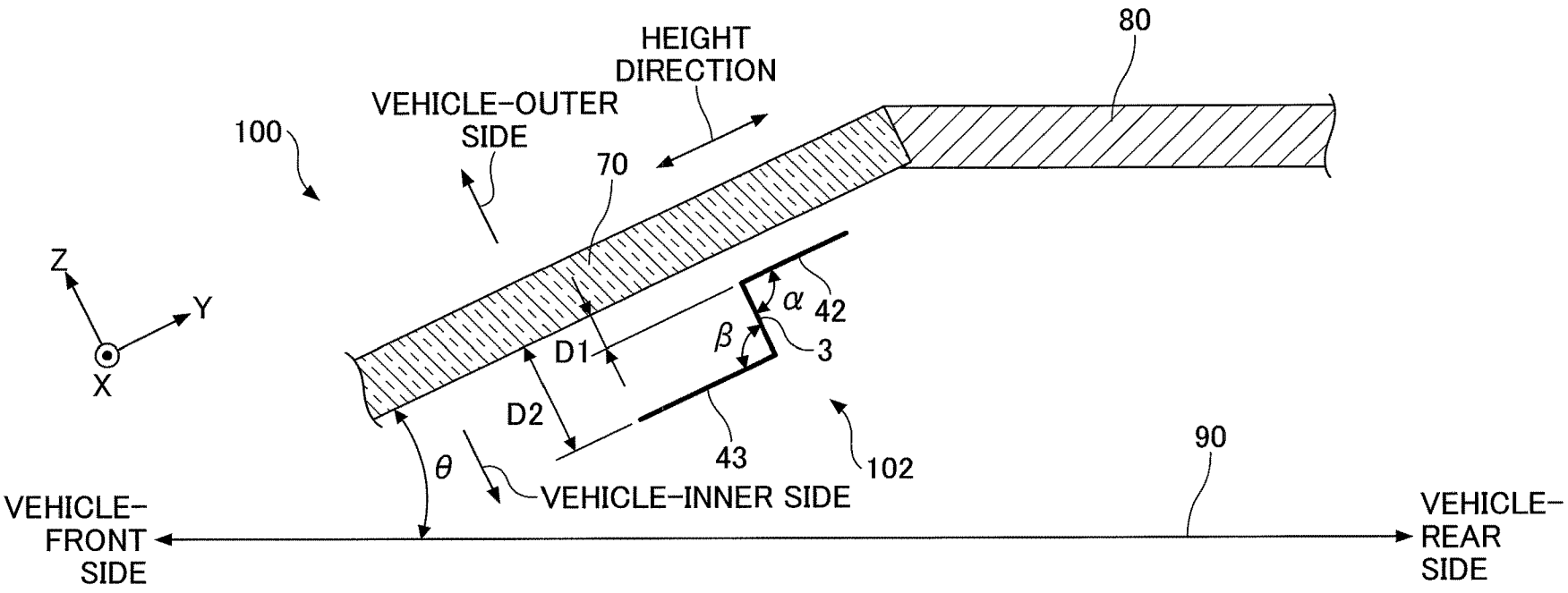
FIG. 7 is a cross sectional view schematically illustrating an example of a configuration of an antenna and an antenna-attached window glass for a vehicle.

Also, in the antenna 101 illustrated in FIG. 1, the first element portion 22 in which the first gap 13 is provided in the middle portion and the second element portion 23 in which the second gap 14 is provided in the middle portion are formed to face each other in the Y axis direction. Therefore, as illustrated in FIG. 7, when the glass plate 70 is attached at an angle of θ degrees with respect to the horizontal plane 90, the first element portion 22 and the second element portion 23 appear to face each other in the vertical direction as viewed from a front of the vehicle toward a rear of the vehicle in a direction parallel with the horizontal plane 90. In other words, the first element portion 22 and the second element portion 23 are formed so as to appear to face each other in the vertical direction when a surface of the glass plate 70 is viewed in a direction parallel with the horizontal plane 90 while the glass plate 70 is attached with an inclination with respect to the horizontal plane. It should be noted that the vertical direction means a direction perpendicular to the horizontal plane 90. The details of FIG. 7 will be explained later.

As described above, while the antenna of FIG. 1 is attached to a predetermined attachment portion, the first element portion 22 and the second element portion 23 are located at portions facing each other in a direction perpendicular to the horizontal plane when the antenna 101 is seen in a direction parallel with the horizontal plane. Therefore, while the antenna 101 is attached to a predetermined attachment portion, the first gap 13 and the second gap 14 face each other in a direction substantially perpendicular to the horizontal plane when the antenna 101 is seen in a direction parallel with the horizontal plane 90. Since the first gap 13 and the second gap 14 face each other in a direction substantially perpendicular to the horizontal plane 90 in this manner, the antenna gain of the antenna 101 for transmitting and receiving vertically polarized electromagnetic waves is improved.

In a state in which the antenna 101 is attached to a predetermined attachment portion, a virtual line 24 passing through the first gap 13 and the second gap 14 is preferably substantially parallel with a virtual plane orthogonal to the horizontal plane 90 (i.e., a YZ plane (see FIG. 7) in the present embodiment) when the antenna 101 is viewed in a direction parallel with the horizontal plane 90. Accordingly, the antenna gain of the antenna 101 for transmitting and receiving vertically polarized electromagnetic waves is further improved.

The virtual line 24 passing through the first gap 13 and the second gap 14 is preferably substantially orthogonal to the longitudinal direction of one of the first element portion 22 and the second element portion 23, and more preferably, the virtual line 24 is substantially orthogonal to the respective longitudinal directions of both the first element portion 22 and the second element portion 23. This further improves the antenna gain of antenna 101 for transmitting and receiving vertically polarized electromagnetic waves. In the illustrated embodiment, the virtual line 24 is orthogonal to the respective longitudinal directions of both of the first element portion 22 and the second element portion 23.

The first element portion 22 and the second element portion 23 are preferably substantially parallel. This further improves the antenna gain of antenna 101 for transmitting and receiving vertically polarized electromagnetic waves.

The loop element 10 has an electrical length of approximately one wavelength of the operation frequency. As a result, the loop element 10 can resonate and attain good impedance matching. The electrical length of the loop element 10 represents an electrical length of the loop shape between the first feeding portion 1 and the second feeding portion 2.

The loop element 10 includes a first element between the first feeding portion 1 and the first gap 13, a second element between the first gap 13 and the second gap 14, and a third element between the second gap 14 and the second feeding portion 2. In the embodiment of FIG. 1, the first element is constituted by segments 15 and 16, the second element is constituted by segments 17, 18, and 19, and the third element is constituted by segments 20, 21. In this case, where the electrical length including both of the first element and the third element is denoted as $L_{e1}$, and the electrical length of the second element is denoted as $L_{e2}$, a ratio ($L_{e1}/L_{e2}$) of 0.6 or more and 1.4 or less is advantageous in terms of attaining good impedance matching. When the ratio ($L_{e1}/L_{e2}$) is less than 0.6 or more than 1.4, it is difficult to attain resonance with multiple resonances, which is disadvantageous in terms of widening a frequency range of impedance matching. The ratio ($L_{e1}/L_{e2}$) is preferably 0.7 or more and 1.3 or less, and more preferably, 0.8 or more and 1.2 or less. It should be noted that each of the electrical length $L_{e1}$ and the electrical length $L_{e2}$ corresponds to a length of portions at an inner side with respect to the width of elements as viewed in the thickness direction of the glass plate 70 (i.e., a total length of inner edges of the corresponding element(s), which are along the inner area of the corresponding U-shape) and is a length corrected in view of a dielectric constant and a thickness of a substrate.

Figure 2:
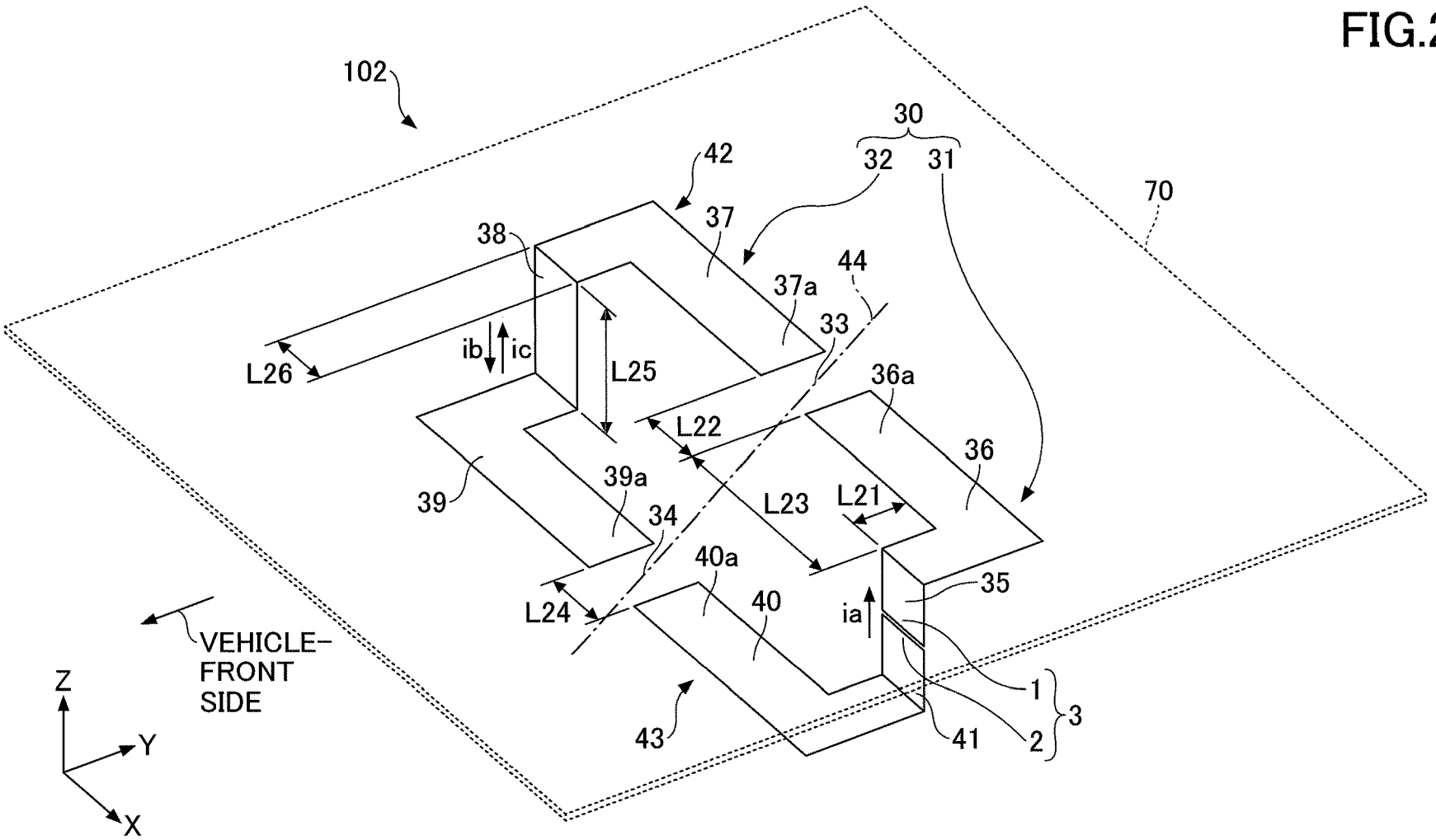
FIG. 2 is a perspective view illustrating a second configuration example of an antenna and an antenna-attached window glass for a vehicle.

FIG. 2 is a perspective view illustrating a second configuration example of an antenna and an antenna-attached window glass for a vehicle as viewed from a viewpoint at a vehicle-outer side. For the second configuration example, explanation about configurations and effects similar to those of the above configuration example will be omitted or abbreviated by referring to the above explanation.

The antenna 102 is a loop antenna including a feeding portion 3 and a loop element 30 connected to the feeding portion 3.

The loop element 30 is a conductor formed in a loop shape having a first end and a second end. The first end of the loop shape is connected to the first feeding portion 1. The second end of the loop shape is connected to the second feeding portion 2. In the loop element 30, a first gap 33 and a second gap 34 are provided in the intermediate sections of the loop shape between the first feeding portion 1 and the second feeding portion 2.

The loop element 30 includes a first antenna conductor 31 formed in a crank shape as viewed in the X axis direction and a second antenna conductor 32 formed in a crank shape as viewed in the X axis direction. The first gap 33 and the second gap 34 are present between the first antenna conductor 31 and the second antenna conductor 32. The first antenna conductor 31 and the second antenna conductor 32 may be separated by a distance which allows capacitive coupling via the first gap 33 and the second gap 34.

The first antenna conductor 31 is a feeding conductor connected to the feeding portion 3, whereas the second antenna conductor 32 is a non-feeding conductor not connected to the feeding portion 3 in terms of a direct current. The second antenna conductor 32 is fed from the first antenna conductor 31 via the first gap 33 and the second gap 34.

The first antenna conductor 31 includes segments 35, 36, 40, and 41. The second antenna conductor 32 includes segments 37, 38, and 39.

The segment 35 is a conductor portion extending in the Z axis direction. The segment 35 has a first end and a second end. The first end of the segment 35 is connected to the first feeding portion 1. The second end of the segment 35 is connected to a first end of the segment 36. The segment 36 is a conductor portion extending in an L-shape in the XY plane. The segment 36 has the first end and a second end. The first end of the segment 36 is connected to the second end of the segment 35. The second end 36*a* faces a first end 37*a* of the segment 37 via the first gap 33 in the X axis direction.

The segment 37 is a conductor portion that extends in an L-shape in the XY plane. The segment 37 has the first end 37*a* and a second end. The first end 37*a* faces the second end 36*a* of the segment 36 via the first gap 33 in the X axis direction. The second end of the segment 37 is connected to a first end of the segment 38. The segment 38 is a conductor portion extending in the Z axis direction. The segment 38 has the first end and a second end. The first end of the segment 38 is connected to the second end of the segment 37. The second end of the segment 38 is connected to a first end of the segment 39. The segment 39 is a conductor portion extending in an L-shape in an XY plane, which is different from the XY plane in which the segment 37 extends. The segment 39 has the first end and a second end 39*a*. The first end of the segment 39 is connected to the second end of the segment 38. The second end 39*a* faces the first end 40*a* of the segment 40 via the second gap 34 in the X axis direction. The external contour of the L-shape in the XY plane may be a straight line or a curved line. A corner portion of the L-shape in the XY plane is not limited to a right angle but may be formed at an angle other than the right angle, or may be rounded in a curved shape.

The segment 40 is a conductor portion extending in an L-shape in an XY plane, which is different from the XY plane in which the segment 36 extends. The segment 40 has a first end 40*a* and a second end. The first end 40*a* faces the second end 39*a* of the segment 39 via the second gap 34 in the X axis direction. The second end of the segment 40 is connected to a first end of the segment 41. The segment 41 is a conductor portion extending in the Z axis direction. The segment 41 has the first end and a second end. The first end of the segment 41 is connected to the second end of the segment 40. The second end of the segment 41 is connected to the second feeding portion 2.

The loop element 30 includes a first element portion 42 and a second element portion 43 arranged substantially parallel with each other with a certain distance in the Z axis direction as viewed in the Y axis direction. The first element portion 42 is constituted by the segments 36, 37, and the second element portion 43 is constituted by the segments 39, 40. In the illustrated embodiment, the first element portion 42 and the second element portion 43 are present in virtual planes different from each other. More specifically, the first element portion 42 is present in a first plane, which is virtual, and the second element portion 43 is present in a second plane, which is virtual, substantially parallel with the first plane. The first and second planes are substantially parallel with the XY plane.

Since the first element portion 42 and the second element portion 43 are in different virtual planes, the first gap 33 and the second gap 34 which are at different heights in the Z axis direction are formed. According to the antenna 102 having such a three-dimensional structure, the directivity in a direction parallel with the horizontal plane (horizontal direction) is improved, and the antenna gain for vertically polarized electromagnetic waves propagating in the horizontal direction is improved.

In the antenna 102, at least one of the first feeding portion 1 and the second feeding portion 2 is present in a third plane between the first plane and the second plane. The third plane is a virtual plane. In the illustrated embodiment, both of the first feeding portion 1 and the second feeding portion 2 are present in the third plane that is orthogonal to the XY plane and that is parallel with the ZX plane.

In the middle of the first element portion 42, the first gap is provided. The middle portion where the first gap 33 is provided is located between the first end of the segment 36 (i.e., the end to which the segment 35 is connected) and the second end of the segment 37 (i.e., the end to which the segment 38 is connected). In the illustrated embodiment, the first gap 33 is provided at the center position between the first end of the segment 36 and the second end of the segment 37.

In the middle of the second element portion 43, the second gap 34 is provided. The middle portion where the second gap 34 is provided is located between the first end of the segment 39 (i.e., the end to which the segment 38 is connected) and the second end of the segment 40 (i.e., the end to which the segment 41 is connected). In the illustrated embodiment, the second gap 34 is provided at the center position between the first end of the segment 39 and the second end of the segment 40.

Thus, in the antenna 102 illustrated in FIG. 2, the loop element 30 is provided so that the first gap 33 and the second gap 34 are inserted in the intermediate sections of the loop shape between the first feeding portion 1 and the second feeding portion 2. In the illustrated embodiment, the first gap 33 is provided in the longitudinal direction of the first element portion 42 in the middle of the first element portion 42. The second gap 34 is provided in the longitudinal direction of the second element portion 43 in the middle of the second element portion 43.

Since the first gap 33 and the second gap 34 are provided in this manner, the loop element 30 resonates with multiple resonances by two resonance modes in which the resonance frequencies are different. Further, the antenna 102 which can attain good impedance matching over a wide frequency range can be achieved with multiple resonances of the loop element 30.

In the antenna 102 as illustrated in FIG. 2, the first element portion 42 in which the first gap 33 is provided and the second element portion 43 in which the second gap 34 is provided are formed to be arranged substantially parallel with each other with a certain distance in the Z axis direction as viewed in the Y axis direction. Therefore, as illustrated in FIG. 7, when the glass plate 70 is attached at an angle of θ degrees with respect to the horizontal plane 90, the first gap 33 and the second gap 34 face each other in a direction substantially perpendicular to the horizontal plane 90 as viewed from a front of the vehicle toward a rear of the vehicle in a direction parallel with the horizontal plane 90. Since the first gap 33 and the second gap 34 face each other in the direction substantially perpendicular to the horizontal plane 90, the antenna gain (actual gain) of the antenna 102 for transmitting and receiving vertically polarized electromagnetic waves is improved.

In a state in which the antenna 102 is attached to a predetermined attachment portion, a virtual line 44 passing through the first gap 33 and the second gap 34 is preferably substantially parallel with a virtual plane orthogonal to the horizontal plane 90 (i.e., a YZ plane (see FIG. 7) in the present embodiment) when the antenna 102 is viewed in a direction parallel with the horizontal plane 90. Accordingly, the antenna gain of the antenna 102 for transmitting and receiving vertically polarized electromagnetic waves is further improved. In the illustrated embodiment, the virtual line 44 is orthogonal to the respective longitudinal directions of both of the first element portion 42 and the second element portion 43.

The first element portion 42 and the second element portion 43 are preferably substantially parallel with each other. Accordingly, the antenna gain of the antenna 102 for transmitting and receiving vertically polarized electromagnetic waves is further improved.

The loop element 30 has an electrical length of approximately one wavelength of the operation frequency. As a result, the loop element 30 can resonate and attain good impedance matching. The electrical length of the loop element 30 represents an electrical length for the loop shape between the first feeding portion 1 and the second feeding portion 2.

The loop element 30 includes a first element between the first feeding portion 1 and the first gap 33, a second element between the first gap 33 and the second gap 34, and a third element between the second gap 34 and the second feeding portion 2. In the embodiment of FIG. 2, the first element is constituted by segments 35, 36, the second element is constituted by segments 37, 38, and 39, and the third element is constituted by segments 40, 41. In this case, where the electrical length including both of the first element and the third element is denoted as $L_{e1}$, and the electrical length of the second element is denoted as $L_{e2}$, a ratio ($L_{e1}/L_{e2}$) of 0.6 or more and 1.4 or less is advantageous in terms of attaining good impedance matching. When the ratio ($L_{e1}/L_{e2}$) is less than 0.6 or more than 1.4, it is difficult to attain resonance with multiple resonances, which is disadvantageous in terms of widening a frequency range of impedance matching. The ratio ($L_{e1}/L_{e2}$) is preferably 0.7 or more and 1.3 or less, and more preferably, 0.8 or more and 1.2 or less. It should be noted that each of the electrical length $L_{e1}$ and the electrical length $L_{e2}$ corresponds to a length of portions at an inner side with respect to the width of elements and is a length corrected in view of a dielectric constant and a thickness of a substrate.

Figure 3:
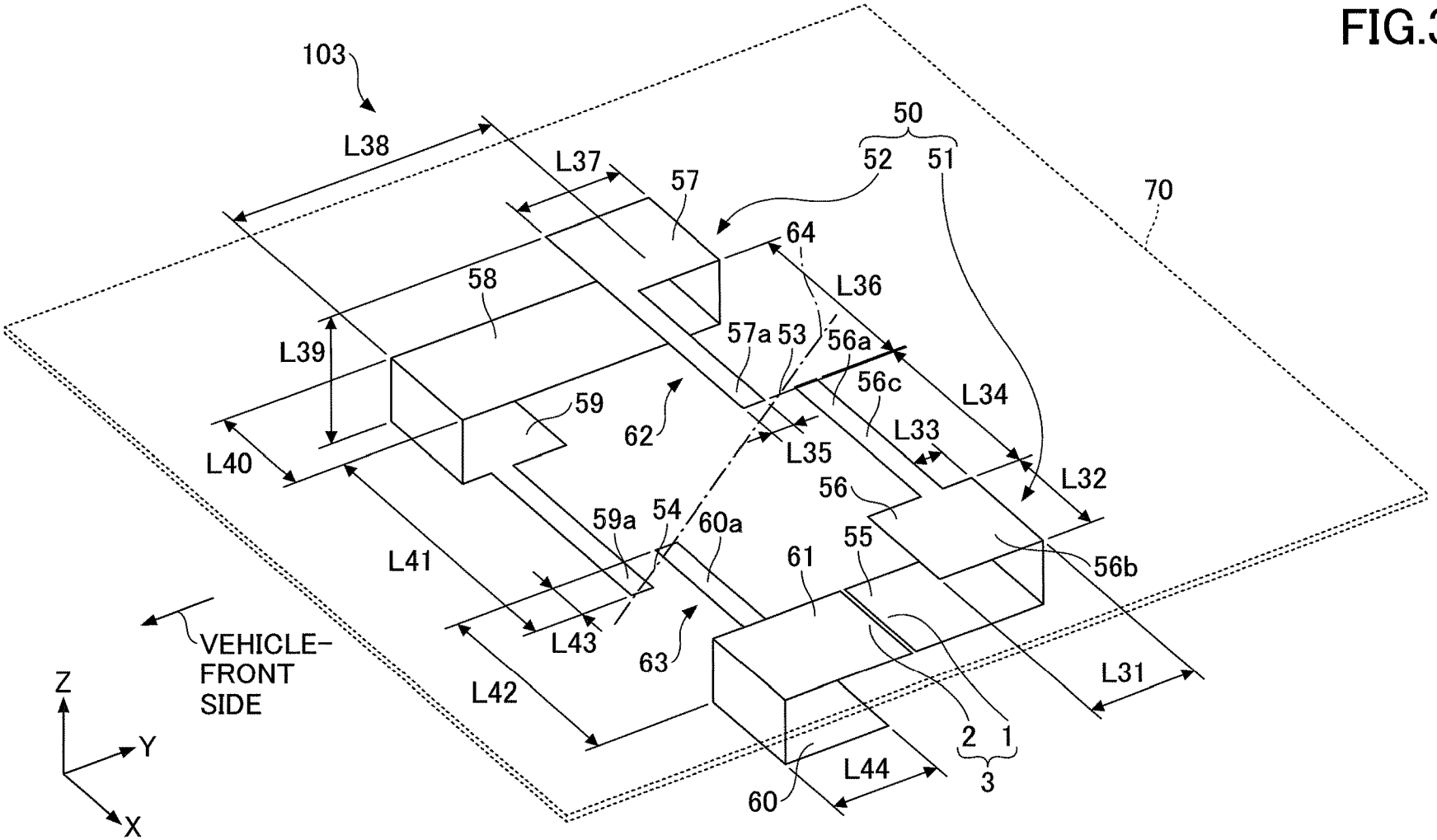
FIG. 3 is a perspective view illustrating a third configuration example of an antenna and an antenna-attached window glass for a vehicle.

FIG. 3 is a perspective view illustrating a third configuration of an antenna and an antenna-attached window glass for a vehicle example as viewed from a viewpoint at a vehicle-outer side. For the third configuration example, explanation about configurations and effects similar to those of the above configuration example will be omitted or abbreviated by referring to the above explanation.

The antenna 103 is a loop antenna including a feeding portion 3 and a loop element 50 connected to the feeding portion 3.

The loop element 50 is a conductor formed in a loop shape having a first end and a second end. The first end of the loop shape is connected to the first feeding portion 1. The second end of the loop shape is connected to the second feeding portion 2. In the loop element 50, a first gap 53 and a second gap 54 are provided in the intermediate sections of the loop shape between the first feeding portion 1 and the second feeding portion 2.

As viewed in the X axis direction, the loop element 50 includes a first antenna conductor 51 formed with two folded-back shapes which are folded back in directions opposite to each other and a second antenna conductor 52 formed with two folded-back shapes which are folded back in directions opposite to each other. The first gap 53 and the second gap 54 are present between the first antenna conductor 51 and the second antenna conductor 52. The first antenna conductor 51 and the second antenna conductor 52 may be separated by a distance which allows capacitive coupling via the first gap 53 and the second gap 54.

The first antenna conductor 51 is a feeding conductor connected to the feeding portion 3, whereas the second antenna conductor 52 is a non-feeding conductor not connected to the feeding portion 3 in terms of a direct current. The second antenna conductor 52 is fed from the first antenna conductor 51 via the first gap 53 and the second gap 54.

The first antenna conductor 51 includes segments 55, 56, 60, and 61. The second antenna conductor 52 includes segments 57, 58, and 59.

The segment 55 is a conductor portion extending in an L-shape as viewed in the X axis direction. The segment 55 has a first end and a second end. The first end of the segment 55 is connected to the first feeding portion 1. The second end of the segment 55 is connected to a first end of the segment 56. The segment 56 is a conductor portion extending in the X axis direction. The segment 56 has the first end and a second end 56*a*. The first end of the segment 56 is connected to the second end of the segment 55. The second end 56*a* faces a first end 57*a* of the segment 57 via the first gap 53 in the Y axis direction.

The segment 56 includes a proximal end portion 56*b* connected to the second end of the segment 55 and a distal end portion 56*c* of which width is different from the proximal end portion 56*b*. The distal end portion 56*c* is a portion including the second end 56*a*. When the width of the distal end portion 56*c* is changed, the strength of capacitive coupling in the first gap 53 changes, so that the resonance frequency of the antenna 103 can be adjusted. By adjusting the resonance frequency of the antenna 103, the antenna 103 attaining good impedance matching over a wide frequency range can be achieved. In the present embodiment, the width of the distal end portion 56*c* in the Y axis direction is narrower than the width of the proximal end portion 56*b* in the Y axis direction. The segments 57, 59, and 60 are similar to the segment 56 in that the width of the proximal end portion and the width of the distal end portion are different from each other, and that the resonance frequency can be adjusted by changing the width of the distal end portion. The external contour of the L-shape of the segment 55 and the like may be a straight line or a curved line. A corner portion of the L-shape of the segment 55 and the like is not limited to a right angle but may be formed at an angle other than the right angle, or may be rounded in a curved shape.

The segment 57 is a conductor portion extending in the X axis direction. The segment 57 has a first end 57*a* and a second end. The first end 57*a* faces the second end 56*a* of the segment 56 via the first gap 53 in the Y axis direction. The second end of the segment 57 is connected to a first end of the segment 58. The segment 58 is a conductor portion extending in a crank shape as viewed in the X axis direction. The segment 58 has the first end and a second end. The first end of the segment 58 is connected to the second end of the segment 57. The second end of the segment 58 is connected to a first end of the segment 59. The segment 59 is a conductor portion extending in the X axis direction in an XY plane, which is different from the XY plane in which the segment 57 extends. The segment 59 has the first end and a second end 59*a*. The first end of the segment 59 is connected to the second end of the segment 58. The second end 59*a* faces a first end 60*a* of the segment 60 via the second gap 54 in the Y axis direction.

The segment 60 is a conductor portion extending in an L-shape in the X axis direction in an XY plane, which is different from the XY plane in which the segment 56 extends. The segment 60 has the first end 60*a* and a second end. The first end 60*a* faces the second end 59*a* of the segment 59 via the second gap 54 in the Y axis direction. The second end of the segment 60 is connected to a first end of the segment 61. The segment 61 is a conductor portion extending in the L-shape as viewed in the X axis direction. The segment 61 has the first end and a second end. The first end of the segment 61 is connected to the second end of the segment 60. The second end of the segment 61 is connected to the second feeding portion 2.

The loop element 50 includes a first element portion 62 and a second element portion 63 arranged substantially parallel with each other with a certain distance in the Z axis direction as viewed in the Y axis direction. The first element portion 62 is constituted by segments 56, 57, and the second element portion 63 is constituted by segments 59, 60. In the illustrated embodiment, the first element portion 62 and the second element portion 63 are present in virtual planes different from each other. More specifically, the first element portion 62 is present in a first plane, which is virtual, and the second element portion 63 is present in a second plane, which is virtual, substantially parallel with the first plane. The first and second planes are substantially parallel with the XY plane.

Since the first element portion 62 and the second element portion 63 are in different virtual planes, the first gap 53 and the second gap 54 which are at different heights in the Z axis direction are formed. According to the antenna 103 having such a three-dimensional structure, the directivity in a direction parallel with the horizontal plane (horizontal direction) is improved, and the antenna gain for vertically polarized electromagnetic waves propagating in the horizontal direction is improved.

At least one of the first feeding portion 1 and the second feeding portion 2 is present in a third plane between the first plane and the second plane. The third plane is a virtual plane. In the illustrated embodiment, both of the first feeding portion 1 and the second feeding portion 2 are present in the third plane parallel with the XY plane.

In the middle of the first element portion 62, the first gap is provided. The middle portion where the first gap 53 is provided is located between the first end of the segment 56 (i.e., the end to which the segment 55 is connected) and the second end of the segment 57 (i.e., the end to which the segment 58 is connected). In the illustrated embodiment, the first gap 53 is provided at the center position between the first end of the segment 56 and the second end of the segment 57.

In the middle of the second element portion 63, the second gap 54 is provided. The middle portion where the second gap 54 is provided is located between the first end of the segment 59 (i.e., the end to which the segment 58 is connected) and the second end of the segment 60 (i.e., the end to which the segment 61 is connected). In the illustrated embodiment, the second gap 54 is provided at the center position between the first end of the segment 59 and the second end of the segment 60.

Thus, in the antenna 103 illustrated in FIG. 3, the loop element 50 is provided so that the first gap 53 and the second gap 54 are inserted in the intermediate sections of the loop shape between the first feeding portion 1 and the second feeding portion 2. In the illustrated embodiment, the first gap 53 is provided, in a middle of the first element portion 62, in a direction (Y axis direction) orthogonal to the longitudinal direction (X axis direction) of the first element portion 62. The second gap 54 is provided, in a middle of the second element portion 63, in a direction (Y axis direction) orthogonal to a longitudinal direction (X axis direction) of the second element portion 63.

Even in a case where the first gap 53 and the second gap 54 are provided in the direction orthogonal to the longitudinal direction of the first element portion 62 and the second element portion 63 in this way, the loop element 50 resonates with multiple resonances by two resonance modes in which the resonance frequencies are different. Further, the antenna 103 which can attain good impedance matching over a wide frequency range can be achieved with multiple resonances of the loop element 50.

In the antenna 103 as illustrated in FIG. 3, the first element portion 62 in which the first gap 53 is provided and the second element portion 63 in which the second gap 54 is provided are formed to be arranged substantially parallel with each other with a certain distance in the Z axis direction as viewed in the Y axis direction. Therefore, as illustrated in FIG. 7, when the glass plate 70 is attached at an angle of θ degrees with respect to the horizontal plane 90, the first gap 53 and the second gap 54 face each other in a direction substantially perpendicular to the horizontal plane 90 as viewed from a front of the vehicle toward a rear of the vehicle in a direction parallel with the horizontal plane 90. Since the first gap 53 and the second gap 54 face each other in the direction substantially perpendicular to the horizontal plane 90, the antenna gain (actual gain) of the antenna 103 for transmitting and receiving vertically polarized electromagnetic waves is improved.

In a state in which the antenna 103 is attached to a predetermined attachment portion, a virtual line 64 passing through the first gap 53 and the second gap 54 is preferably substantially parallel with a virtual plane orthogonal to the horizontal plane 90 (i.e., a YZ plane (see FIG. 7) in the present embodiment) when the antenna 103 is viewed in a direction parallel with the horizontal plane 90. Accordingly, the antenna gain of the antenna 102 for transmitting and receiving vertically polarized electromagnetic waves is further improved. In the illustrated embodiment, the virtual line 64 is orthogonal to the respective longitudinal directions of both of the first element portion 62 and the second element portion 63.

The first element portion 62 and the second element portion 63 are substantially parallel with each other. Accordingly, the antenna gain of the antenna 103 for transmitting and receiving vertically polarized electromagnetic waves is further improved.

The loop element 50 has an electrical length of approximately one wavelength of the operation frequency. As a result, the loop element 50 can resonate and attain good impedance matching. The electrical length of the loop element 50 represents an electrical length for the loop shape between the first feeding portion 1 and the second feeding portion 2.

The loop element 50 includes a first element between the first feeding portion 1 and the first gap 53, a second element between the first gap 53 and the second gap 54, and a third element between the second gap 54 and the second feeding portion 2. In the embodiment of FIG. 3, the first element is constituted by segments 55, 56, the second element is constituted by segments 57, 58, and 59, and the third element is constituted by segments 60, 61. In this case, where the electrical length including both of the first element and the third element is denoted as $L_{e1}$, and the electrical length of the second element is denoted as $L_{e2}$, a ratio ($L_{e1}/L_{e2}$) of 0.6 or more and 1.4 or less is advantageous in terms of attaining good impedance matching. When the ratio ($L_{e1}/L_{e2}$) is less than 0.6 or more than 1.4, it is difficult to attain resonance with multiple resonances, which is disadvantageous in terms of widening a frequency range of impedance matching. The ratio ($L_{e1}/L_{e2}$) is preferably 0.7 or more and 1.3 or less, and more preferably, 0.8 or more and 1.2 or less. It should be noted that each of the electrical length $L_{e1}$ and the electrical length $L_{e2}$ corresponds to a length of portions at an inner side with respect to the width of elements and is a length corrected in view of a dielectric constant and a thickness of a substrate.

Figure 4:
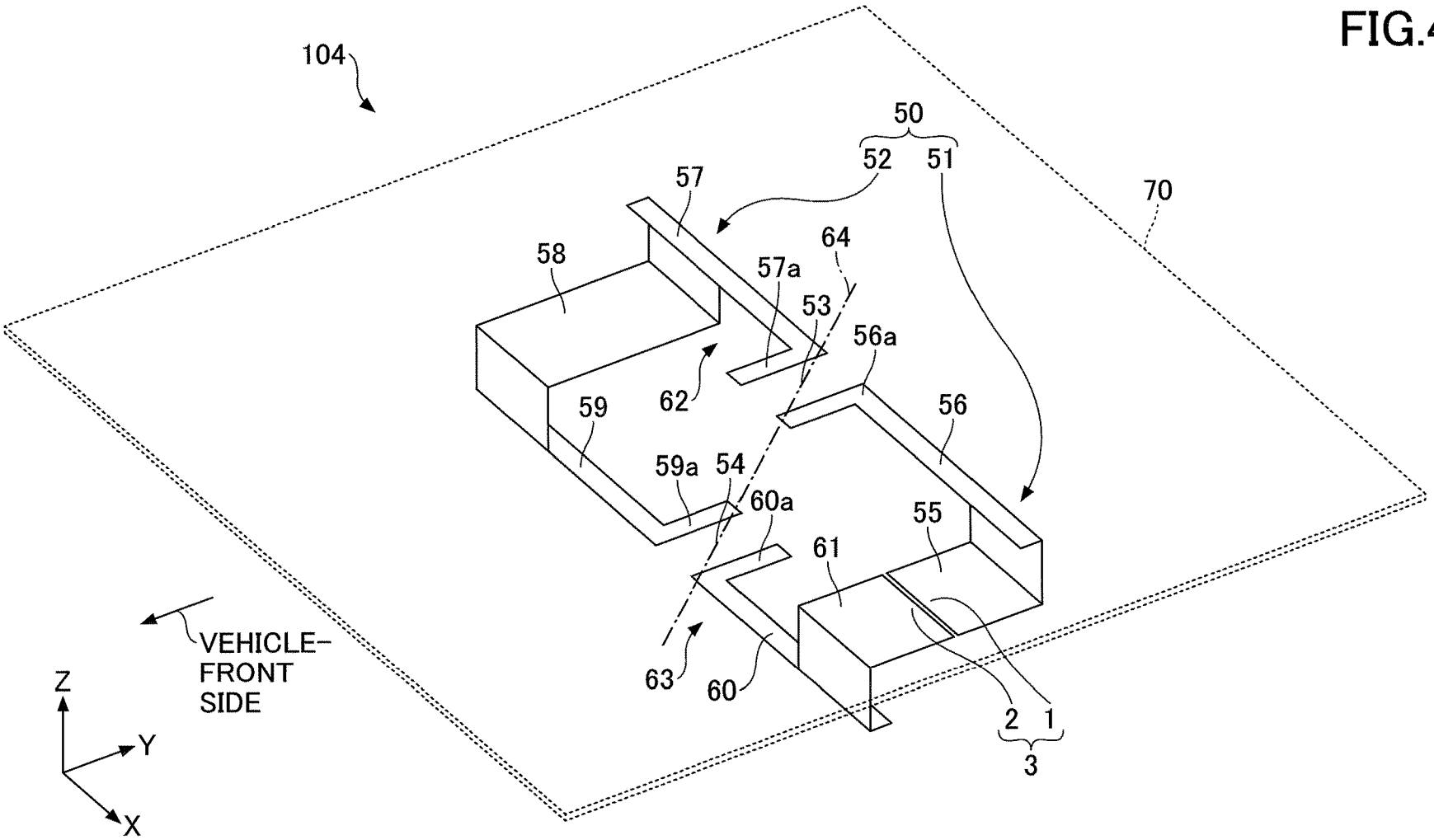
FIG. 4 is a perspective view illustrating a modification (fourth configuration example) of the third configuration of the antenna and the antenna-attached window glass for a vehicle.

FIG. 4 is a perspective view illustrating a fourth configuration example of an antenna and an antenna-attached window glass for a vehicle as viewed from a viewpoint at a vehicle-outer side. For the fourth configuration example, explanation about configurations and effects similar to those of the above configuration example will be omitted or abbreviated by referring to the above explanation. The fourth configuration example is a modification applied to the configuration of FIG. 3.

The antenna 104 is different from FIG. 3 in that the segments 56, 57, 59, and 60 are conductor portions extending in an L-shape in the XY plane. The segment 56 has a first end and a second end 56*a*. The first end of the segment 56 is connected to a second end of the segment 55. The second end 56*a* faces a first end 57*a* of the segment 57 via the first gap 53 in the X axis direction. The segment 57 has the first end 57*a* and a second end. The first end 57*a* faces the second end 56*a* of the segment 56 via the first gap 53 in the X axis direction. The second end of the segment 57 is connected to a first end of the segment 58. The segment 59 has a first end and a second end 59*a*. The first end of the segment 59 is connected to the second end of the segment 58. The second end 59*a* faces a first end 60*a* of the segment 60 via the second gap 54 in the X axis direction. The segment 60 has the first end 60*a* and a second end. The first end 60*a* faces the second end 59*a* of the segment 59 via the second gap 54 in the X axis direction. The second end of the segment 60 is connected to a first end of the segment 61. The external contour of the L-shape in the XY plane may be a straight line or a curved line. A corner portion of the L-shape in the XY plane is not limited to a right angle but may be formed at an angle other than the right angle, or may be rounded in a curved shape.

In the illustrated embodiment, the first gap 53 is provided, in a middle of the first element portion 62, in a longitudinal direction of the first element portion 62. The second gap 54 is provided, in a middle of the second element portion 63, in a longitudinal direction of the second element portion 63.

Figure 5:
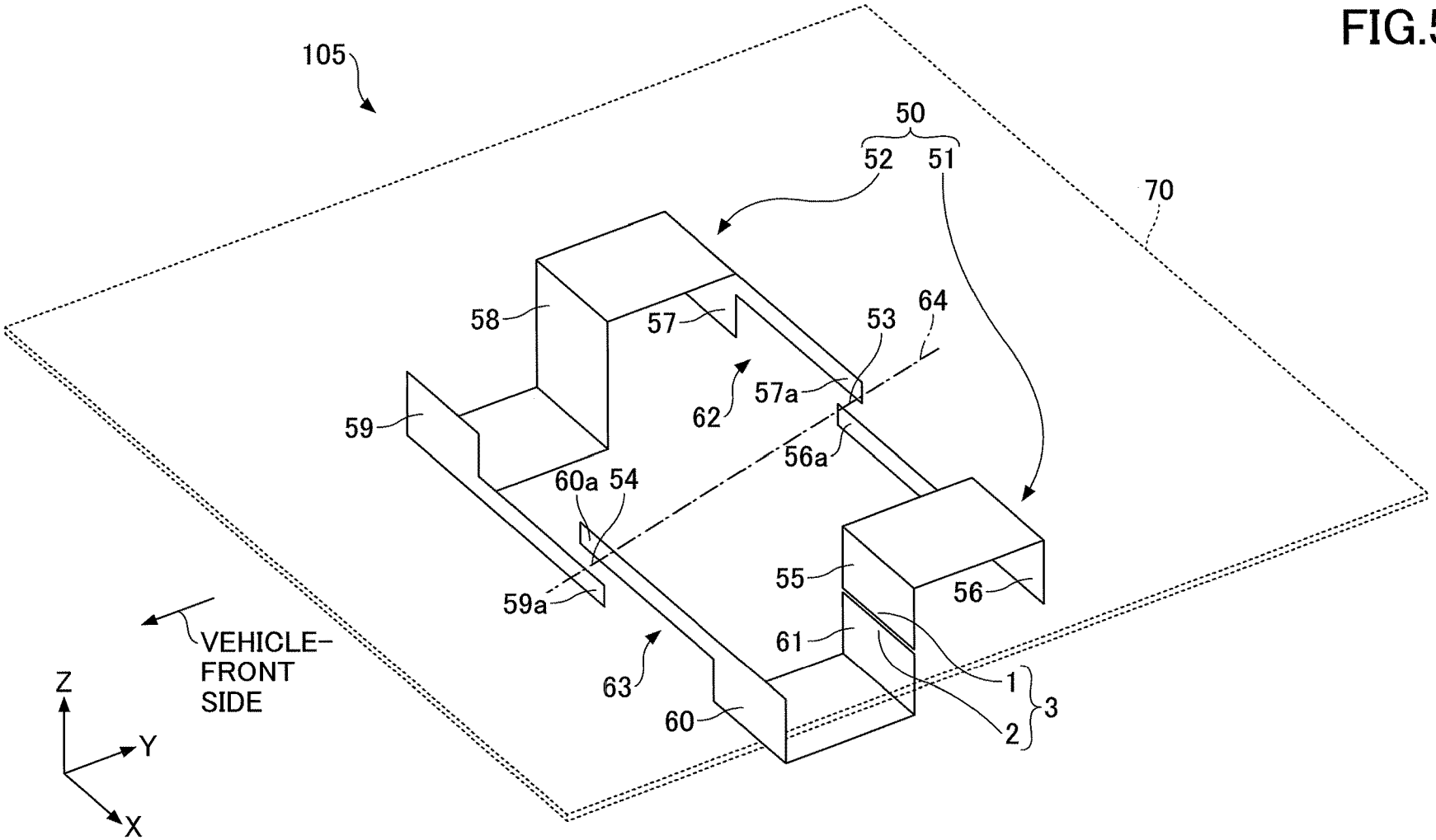
FIG. 5 is a perspective view illustrating a modification (fifth configuration example) of the third configuration of the antenna and the antenna-attached window glass for a vehicle.

FIG. 5 is a perspective view illustrating a fifth configuration example of an antenna and an antenna-attached window glass for a vehicle as viewed from a viewpoint at a vehicle-outer side. For the fifth configuration example, explanation about configurations and effects similar to those of the above configuration example will be omitted or abbreviated by referring to the above explanation. The fifth configuration example is a modification applied to the configuration of FIG. 3.

The antenna 105 is different from FIG. 3 in that the segments 56, 57, 59, and 60 are conductor portions extending in an L-shape in the ZX plane. In addition, the antenna 105 is different from FIG. 3 in that the first feeding portion 1 and the second feeding portion 2 are present in a third plane parallel with the ZX plane. The external contour of the L-shape in the ZX plane may be a straight line or a curved line. A corner portion of the L-shape in the ZX plane is not limited to a right angle but may be formed at an angle other than the right angle, or may be rounded in a curved shape.

The segment 56 has a first end and a second end 56*a*. The first end of the segment 56 is connected to the second end of the segment 55. The second end 56*a* faces a first end 57*a* of the segment 57 via the first gap 53 in the Z axis direction. The segment 57 has the first end 57*a* and a second end. The first end 57*a* faces the second end 56*a* of the segment 56 via the first gap 53 in the Z axis direction. The second end of the segment 57 is connected to a first end of the segment 58. The segment 59 has the first end and a second end 59*a*. The first end of the segment 59 is connected to the second end of the segment 58. The second end 59*a* faces a first end 60*a* of the segment 60 via the second gap 54 in the Z axis direction. The segment 60 has the first end 60*a* and a second end. The first end 60*a* faces the second end 59*a* of the segment 59 via the second gap 54 in the Z axis direction. The second end of the segment 60 is connected to a first end of the segment 61.

In the illustrated embodiment, the first gap 53 is provided, in a middle of the first element portion 62, in a direction (Z axis direction) orthogonal to the longitudinal direction (X axis direction) of the first element portion 62. The second gap 54 is provided, in a middle of the second element portion 63, in a direction (Z axis direction) orthogonal to a longitudinal direction (X axis direction) of the second element portion 63.

Figure 6:
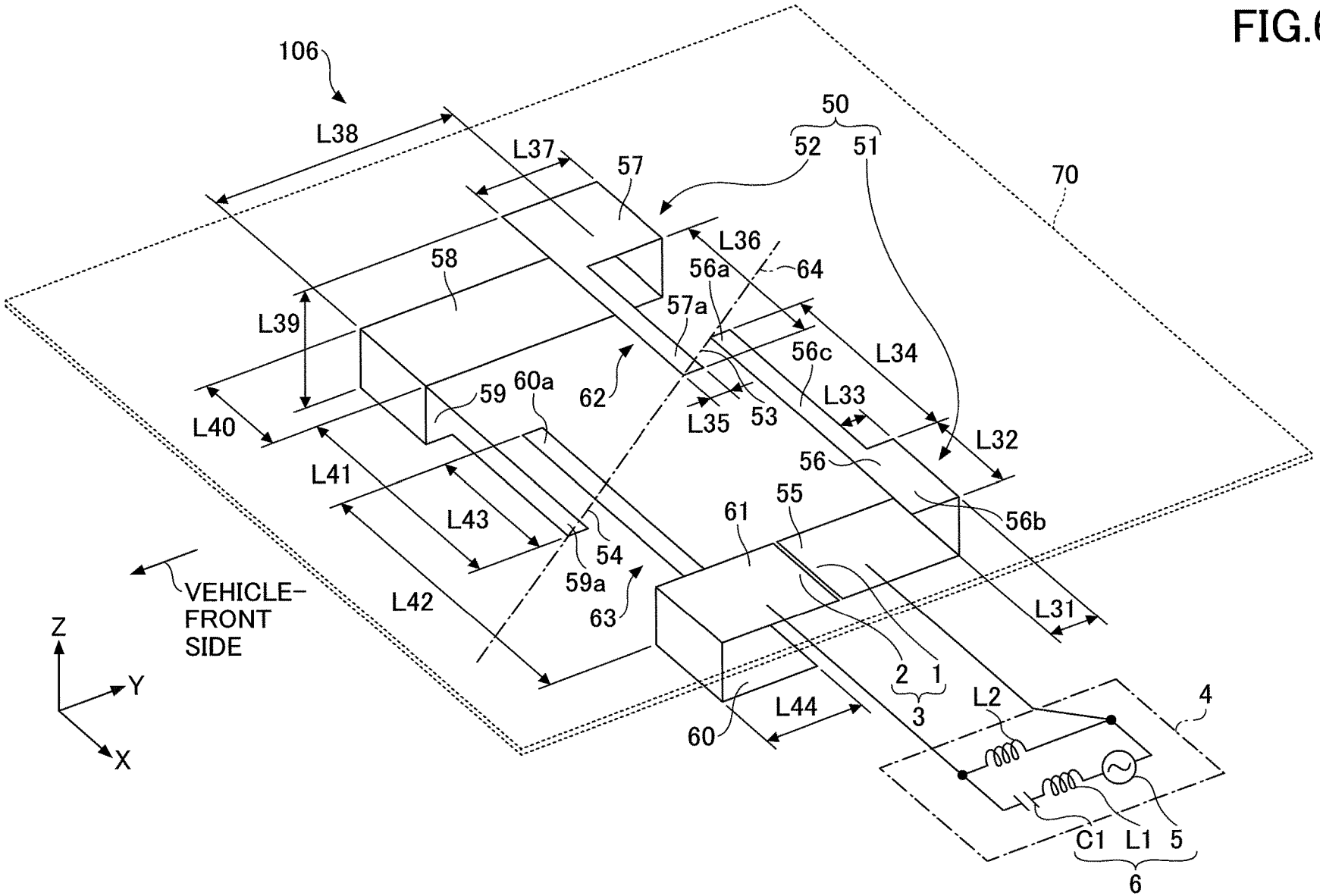
FIG. 6 is a perspective view illustrating a modification (sixth configuration example) of the third configuration of the antenna and the antenna-attached window glass for a vehicle.

FIG. 6 is a perspective view illustrating a sixth configuration example of an antenna and an antenna-attached window glass for a vehicle as viewed from a viewpoint at a vehicle-outer side. For the sixth configuration example, explanation about configurations and effects similar to those of the above configuration example will be omitted or abbreviated by referring to the above explanation. The sixth configuration example is a modification applied to the configuration of FIG. 3.

The antenna 106 is different from the configuration of the antenna 103 of FIG. 3 in that, of the segment 56, the shape of the proximal end portion 56*b* and the shape of the segment 59 are different. In addition, the antenna 106 has, between the first feeding portion 1 and the second feeding portion 2, a matching circuit 4 including an inductance (L) and a capacitance (C). The matching circuit 4 has, for example, between the first feeding portion 1 and the second feeding portion 2, a series circuit 6 and a second inductance (L2). The series circuit 6 has a first inductance (L1) and a first capacitance (C1) connected in series to the feeding point 5. The second inductance (L2) connected in parallel with the series circuit 6.

By adjusting the values of L1, L2, and C1 in this manner, a high gain can be obtained over a wide frequency range, and for example, the gains for the electromagnetic waves in three bands described later (0.698 GHz to 0.96 GHz, 1.71 GHz to 2.17 GHz, 2.4 GHz to 2.69 GHz) can be enhanced. The above matching circuit can also be applied to the first to fifth configuration examples.

FIG. 7 is a cross sectional view taken along a plane perpendicular to the width direction of the vehicle and schematically illustrating an example of a configuration of an antenna and an antenna-attached window glass for a vehicle. In FIG. 7, the X axis direction represents the width direction of the vehicle 80. FIG. 7 illustrates a case where the glass plate 70 is a windshield. The glass plate 70 is attached to a window frame of the vehicle 80 at an angle of θ degrees with respect to the horizontal plane 90. The angle of θ degrees is an angle (for example, 30 degrees) which is more than 0 degrees and equal to or less than 90 degrees.

FIG. 7 illustrates a case where an antenna attached directly or indirectly to the glass plate 70 is the antenna 102 (see FIG. 2). The antenna-attached window glass 100 includes the glass plate 70 and the antenna 102 attached directly or indirectly to the glass plate 70.

A distance D1 (i.e., an example of a first distance) represents a shortest distance between the first element portion 42 and a vehicle-inner-side surface of the glass plate 70. The distance D2 (i.e., an example of a second distance) is a shortest distance between the second element portion 43 and the vehicle-inner-side surface of the glass plate 70. Since the distance D1 and the distance D2 are different, the three-dimensional antenna 102 including the elements with the Z axis direction component can be formed.

The directivity of the planar antenna without the Z axis direction component tends to be stronger in the normal direction of the glass plate 70. In contrast, the antenna 102 according to the present embodiment has an element having the Z axis direction component, so that the direction in which the antenna 102 has a higher directivity is inclined in a direction closer to the horizontal plane 90 relative to the normal direction of the glass plate 70. Therefore, according to the antenna 102 according to the present embodiment, the directivity in the direction parallel with the horizontal plane 90 (horizontal direction) is improved, so that the antenna gain (actual gain) of the horizontal direction can be further increased. The same applies to other three-dimensional antennas according to the present embodiment.

In addition, the antenna 102 according to the present embodiment has an element in a bent shape. When two antennas having the same length are compared, the height of an element in a bent shape bent at two portions is less than the height of an antenna in an L-shape bent at one portion. Since the element is bent at two or more portions, the height (D2-D1) can be easily reduced while ensuring a predetermined antenna length. Therefore, a large protrusion from the vehicle-inner-side surface of the glass plate 70 can be avoided, and the antenna will not cause annoyance to a driver and passengers. The same applies to other three-dimensional antennas according to the present embodiment.

In the antenna 102 according to the present embodiment, a lower end portion of the first element portion 42 and an upper end portion of the second element portion 43 are connected by an element (segments 35, 38, and 41) having the Z axis direction component. Since the first element portion 42 and the second element portion 43 are connected in this manner, the first element portion 42 and the second element portion 43 are not opposed to each other, or the opposing conductor portions are relatively smaller (narrower). Therefore, strong capacitive coupling between the first element portion 42 and the second element portion 43 becomes less likely. Therefore, according to the antenna 102 of the present embodiment, good impedance matching can be attained. The same applies to other three-dimensional antennas according to the present embodiment.

In addition, in terms of improving the horizontal direction directivity, the distance D1 is shorter than the distance D2 as illustrated in FIG. 7. The distance D1 may be zero. When the distance D1 is zero, the first element portion 42 is in contact with the vehicle-inner-side surface of the glass plate 70. The same applies to other three-dimensional antennas according to the present embodiment.

In the embodiment illustrated in FIG. 7, the antenna 102 is arranged at an upper portion of the vehicle-inner side of the glass plate 70 in such a manner that the first element portion 42 and the second element portion 43 are parallel with the vehicle-inner-side surface of the glass plate 70. An angle α represents an angle formed by the first element portion 42 and the element having the Z axis direction component. An angle β represents an angle formed by the second element portion 43 and the element having the Z axis direction component. The angle α is an angle (for example, 90 degrees) larger than 0 degrees and smaller than 180 degrees. The angle β is also an angle (for example, 90 degrees) larger than 0 degrees and smaller than 180 degrees. The same applies to other three-dimensional antennas according to the present embodiment.

The first element portion 42 and the second element portion 43 are not limited to the case where the first element portion 42 and the second element portion 43 are arranged to be parallel with the vehicle-inner-side surface of the glass plate 70, and may be arranged to be non-parallel. The angle α and angle β may be the same angle or different angles. The same applies to other three-dimensional antennas according to the present embodiment.

The antenna according to the present embodiment is suitable for transmitting and receiving electromagnetic waves in the UHF (Ultra High Frequency) band. For example, the antenna is suitable for transmission and reception of electromagnetic waves in three bands (0.698 GHz to 0.96 GHz, 1.71 GHz to 2.17 GHz, and 2.4 GHz to 2.69 GHz) among multiple frequency bands used for LTE (Long Term Evolution).

Furthermore, the antenna according to the present embodiment is also suitable for transmission and reception of electromagnetic waves in the ISM (Industry Science Medical) band. The ISM band includes 0.863 GHz to 0.870 GHz (Europe), 0.902 GHz to 0.928 GHz (USA), and 2.4 GHz to 2.5 GHz (used all over the world). Examples of communication standards using the 2.4 GHz band, which is one of the ISM bands, include wireless LAN (Local Area Network) using DSSS (Direct Sequence Spread Spectrum) compliant with IEEE802.11b, Bluetooth (registered trademark), and some of the FWA (Fixed Wireless Access) system. The electromagnetic waves transmitted and received by the antenna according to the present embodiment are not limited to these frequency bands.

Figure 8:
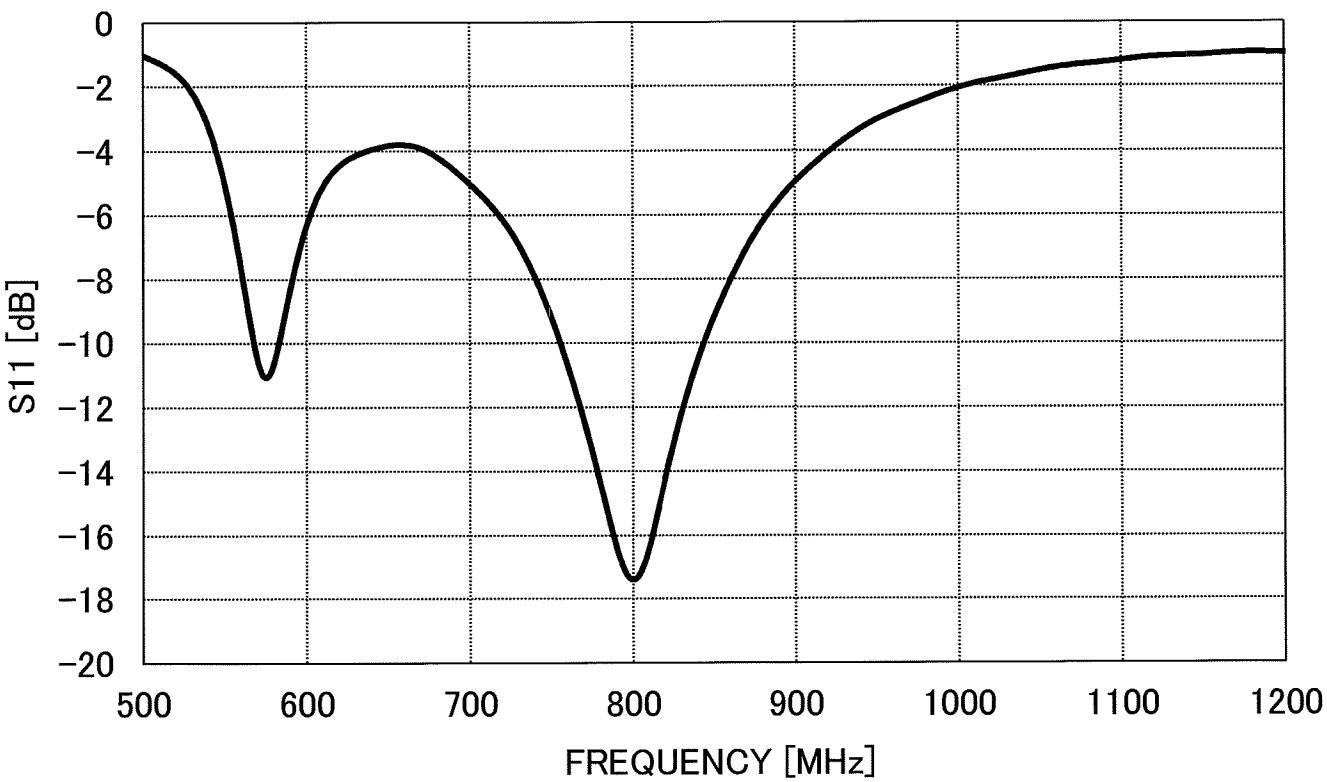
FIG. 8 is a drawing illustrating an example of return loss characteristics of the first configuration example.

FIG. 8 is a drawing illustrating an example of the return loss characteristics simulation of the antenna 101. Microwave Studio (registered trademark) (CST) was used for electromagnetic field simulation. The vertical axis represents the reflection coefficient S11 of each antenna.

The antenna 101 attained good impedance matching over a wide frequency range in the LTE frequency band (0.698 GHz to 0.96 GHz).

Figure 9:
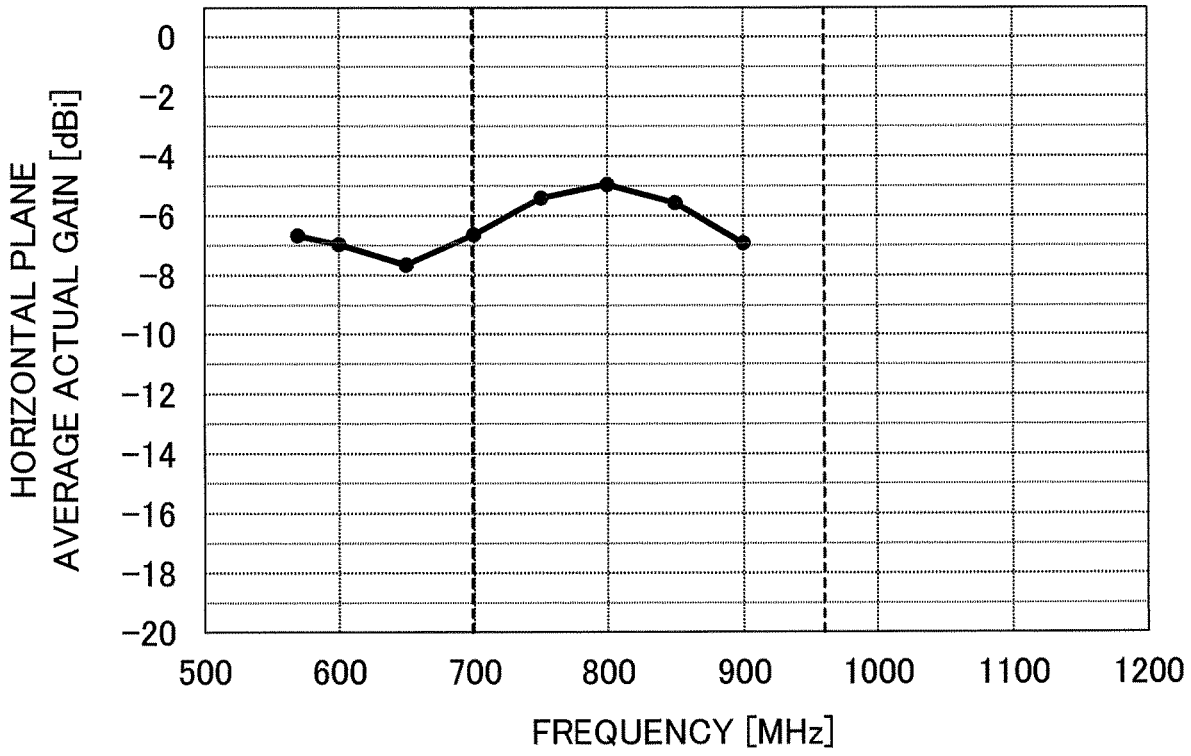
FIG. 9 is a drawing illustrating an example of an actual gain of the first configuration example.

FIG. 9 is a drawing illustrating an example of the actual gain of the antenna 101. In FIG. 9, the vertical axis represents an average value of the antenna gains (actual gains) in horizontal directions from 0 degrees to 360 degrees in the horizontal plane for reception of vertically polarized electromagnetic waves. As illustrated in FIG. 9, the antenna gain in the horizontal direction of the antenna 101 was sufficient in terms of transmitting and receiving vertically polarized electromagnetic waves in the LTE frequency band (0.698 GHz to 0.96 GHz).

When the reflection coefficient and the antenna gain in FIGS. 8 and 9 were analyzed, the size of each part illustrated in FIG. 1 was as follows, in millimeters.

L11: 85
L12: 143
L13: 15
L14: 16
L15: 8

The angle of θ degrees (see FIG. 7) was 30 degrees.

Figure 10:
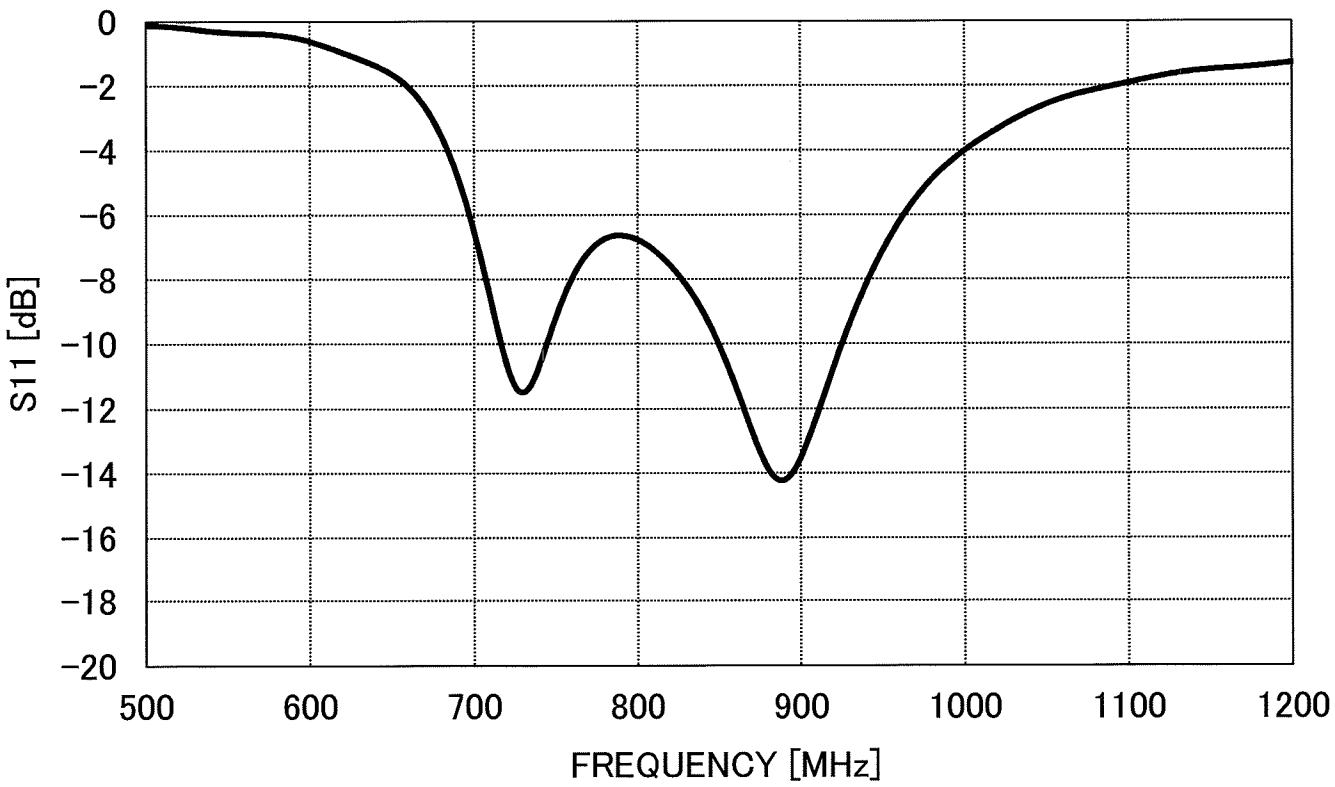
FIG. 10 is a drawing illustrating an example of return loss characteristics of the second configuration example.

FIG. 10 is a drawing illustrating an example of simulation of return loss characteristics of the antenna 102. Microwave Studio (registered trademark) (CST) was used for electromagnetic field simulation. The vertical axis represents the reflection coefficient S11 of each antenna.

The antenna 102 attained good impedance matching over a wide frequency range in the LTE frequency band (0.698 GHz to 0.96 GHz), and better impedance matching over a wider frequency range than the antenna 101.

Figure 11:
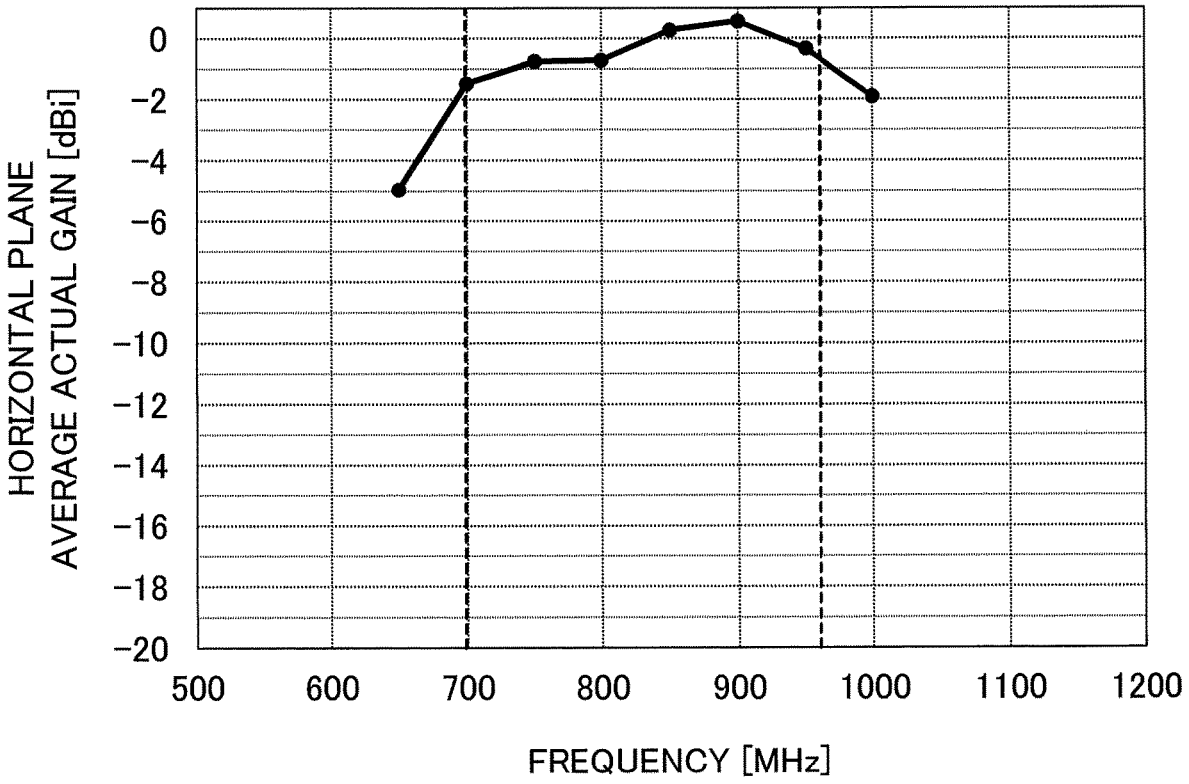
FIG. 11 is a drawing illustrating an example of an actual gain of the second configuration example.

FIG. 11 is a drawing illustrating an example of the actual gain of the antenna 102. In FIG. 11, the vertical axis represents an average value of the antenna gains (actual gains) in horizontal directions from 0 degrees to 360 degrees in the horizontal plane for reception of vertically polarized electromagnetic waves. As illustrated in FIG. 11, the antenna gain in the horizontal direction of the antenna 102 was sufficient in terms of transmitting and receiving vertically polarized electromagnetic waves in the LTE frequency band (0.698 GHz to 0.96 GHz). The antenna 102 attained a higher antenna gain in terms of transmitting and receiving vertically polarized electromagnetic waves than the antenna 101.

When the reflection coefficient and the antenna gain in FIGS. 10 and 11 were analyzed, the size of each part illustrated in FIG. 2 was as follows, in millimeters.

L21: 12.5
L22: 16
L23: 48.5
L24: 8
L25: 30
L26: 15

The angle of θ degrees (see FIG. 7) was 30 degrees.

Figure 12:
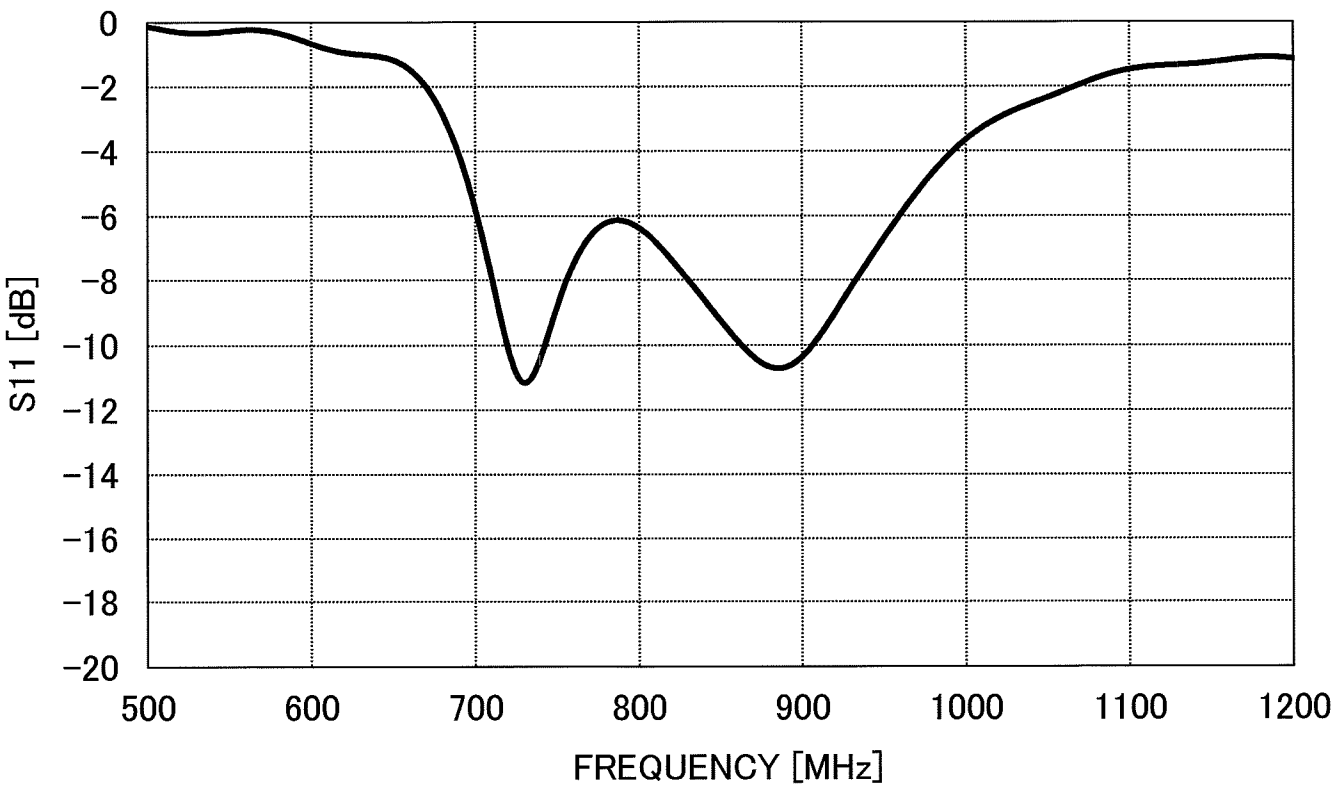
FIG. 12 is a drawing illustrating an example of return loss characteristics of the third configuration example.

FIG. 12 is a drawing illustrating an example of simulation of return loss characteristics of the antenna 103. Microwave Studio (registered trademark) (CST) was used for electromagnetic field simulation. The vertical axis represents the reflection coefficient S11 of each antenna.

The antenna 103 attained good impedance matching over a wide frequency range in the LTE frequency band (0.698 GHz to 0.96 GHz), and attained good impedance matching over a wider frequency range than the antenna 101.

Figure 13:
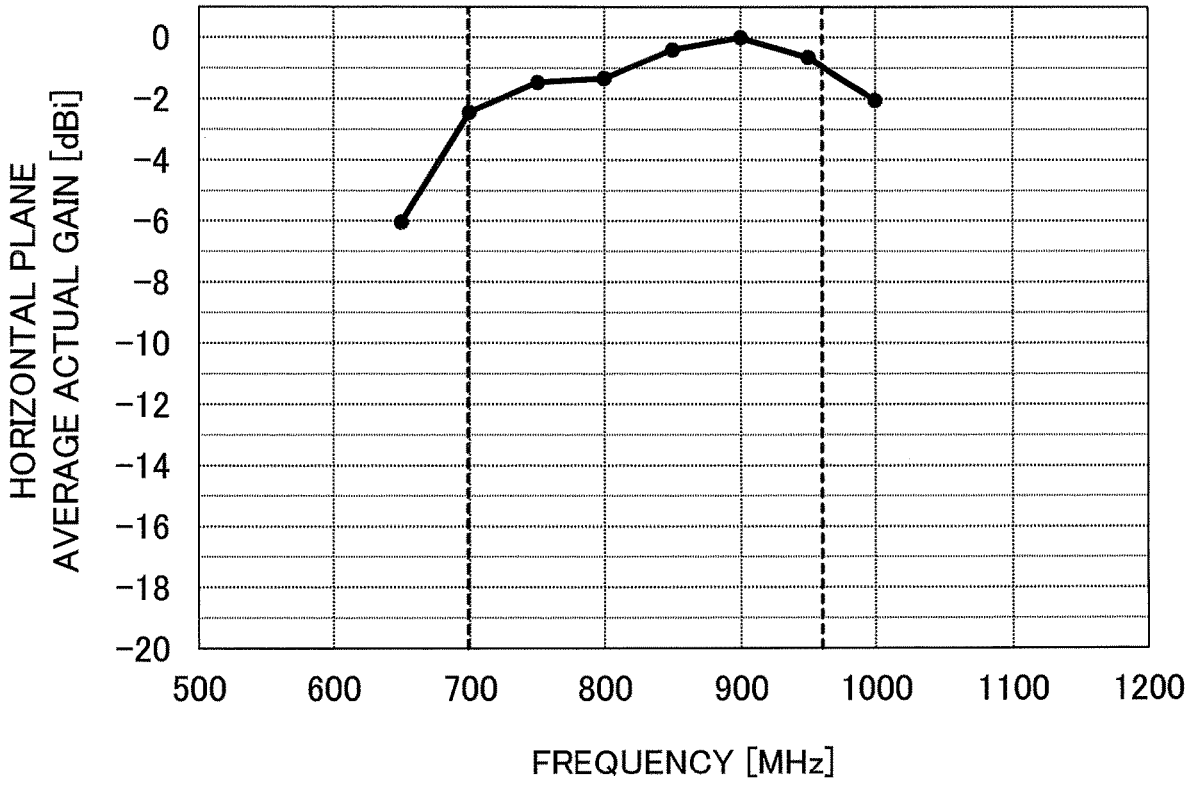
FIG. 13 is a drawing illustrating an example of an actual gain of the third configuration example.

FIG. 13 is a drawing illustrating an example of the actual gain of the antenna 103. In FIG. 13, the vertical axis represents an average value of the antenna gains (actual gains) in horizontal directions from 0 degrees to 360 degrees in the horizontal plane for reception of vertically polarized electromagnetic waves. As illustrated in FIG. 13, the antenna gain in the horizontal direction of the antenna 103 was sufficient in teams of transmitting and receiving vertically polarized electromagnetic waves in the LTE frequency band (0.698 GHz to 0.96 GHz). The antenna 103 attained a higher antenna gain in terms of transmitting and receiving vertically polarized electromagnetic waves than the antenna 101.

When the reflection coefficient and the antenna gain in FIGS. 12 and 13 were analyzed, the size of each part illustrated in FIG. 3 was as follows, in millimeters.

L31: 24
L32: 25.5
L33: 6.5
L34: 45
L35: 5
L36: 45
L37: 24
L38: 60
L39: 30
L40: 25.5
L41: 50
L42: 50
L43: 10.5
L44: 24

The angle of θ degrees (see FIG. 7) was 30 degrees.

Figure 14:
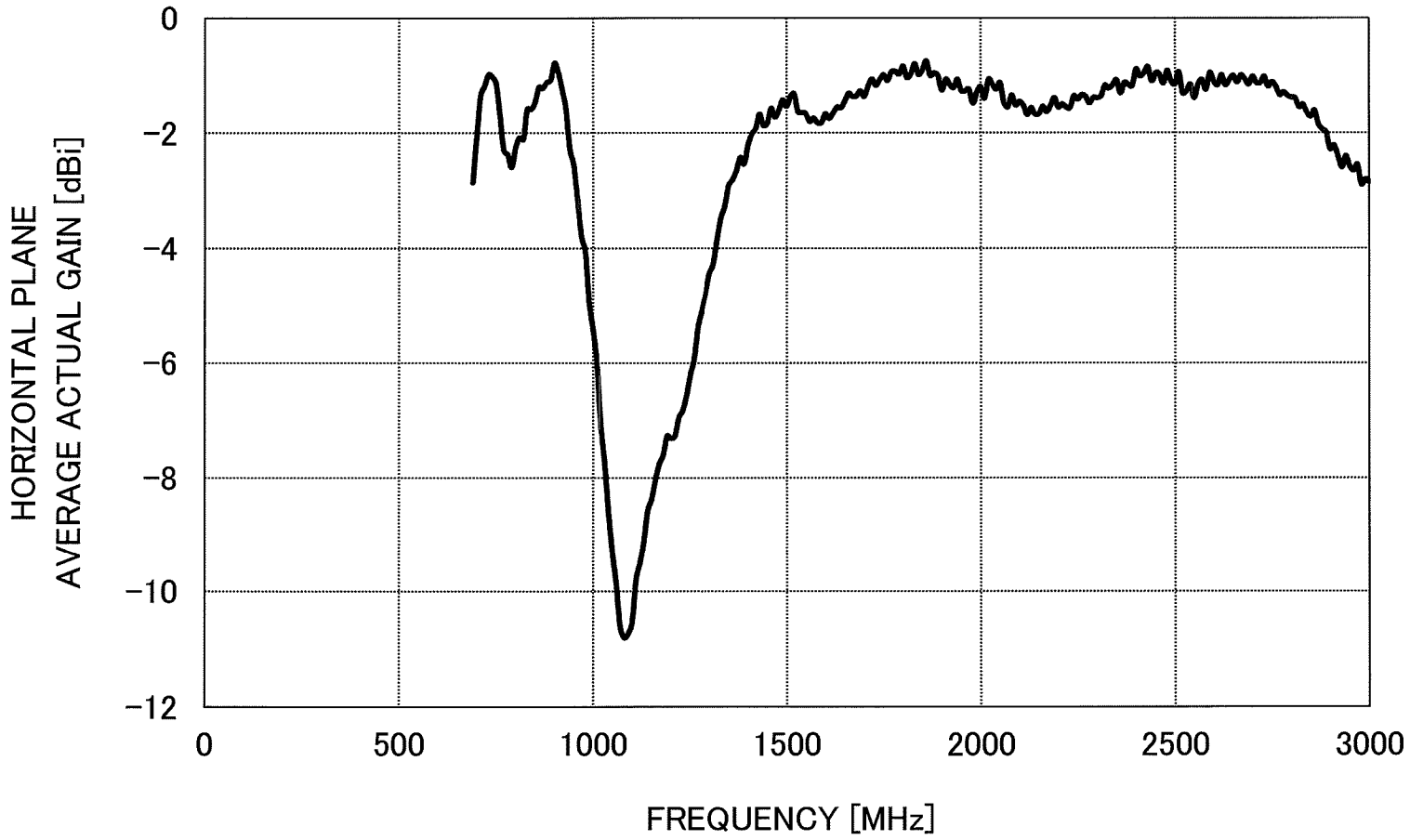
FIG. 14 is a drawing illustrating an example of an actual gain of the sixth configuration example.

FIG. 14 is a drawing illustrating an example of the actual gain of the antenna 106. In FIG. 14, the vertical axis represents an average value of the antenna gains (actual gains) in horizontal directions from 0 degrees to 360 degrees in parallel with the horizontal plane for reception of vertically polarized electromagnetic waves. As illustrated in FIG. 14, the antenna gain in the horizontal direction of the antenna 106 was sufficient in terms of transmitting and receiving vertically polarized electromagnetic waves in three bands (0.698 GHz to 0.96 GHz, 1.71 GHz to 2.17 GHz, 2.4 GHz to 2.69 GHz) used for LTE.

When the antenna gain in FIG. 14 was analyzed, the size of each part illustrated in FIG. 6 was as follows, in millimeters.

L31: 12
L32: 25.5
L33: 7

L34: 42.5
L35: 5
L36: 45.5
L37: 24
L38: 60
L39: 30
L40: 25.5
L41: 45.5
L42: 54.5
L43: 15
L44: 24

The angle of θ degrees (see FIG. 7) was 30 degrees.

The inductances (L1, L2) and the capacitance (C1) were of the following values.

L1: 1.4 nH
L2: 15 nH
C1: 2.4 pF

Although the antenna and the antenna-attached window glass for the vehicle have been hereinabove explained with reference to the embodiment, the present invention is not limited to the above embodiment. Various modifications and improvements, such as combinations of and replacements with some or all of elements of the embodiment, can be made within the scope of the present invention.

For example, in the above embodiment, the glass plate is shown as an example of a substrate to which an antenna is attached, but the substrate is not limited to the glass plate, and may be another member. The substrate may cover the antenna. The material of the substrate is preferably a dielectric.

In addition, the shape of the segment that constitutes an antenna conductor is not limited to a shape that extends linearly, but may be a shape extending in a curved manner with a rounded shape. The shape of a corner of an antenna conductor is not limited to a right angle, but may be rounded like an arc.

The portion where the first gap is provided is not limited to the center position of the first element portion, and may be a position shifted from the center position. The portion where the second gap is provided is not limited to the center position of the second element portion, and may be a position shifted from the center position.

Moreover, although the antenna-attached window glass is shown in the above embodiment as an example of an antenna-attached device, the embodiment is not limited thereto. For example, the antenna-attached device may be a communication device having at least one of a reception function and a transmission function.

What is claimed is:

1. An antenna comprising:

a feeding portion comprising a first feeding portion and a second feeding portion and defining a gap therebetween; and a loop element including a first end and a second end, the first end being connected to the first feeding portion, and the second end being connected to the second feeding portion, wherein the loop element has a first element portion and a second element portion, which appear to face each other in a vertical direction in an elevation view as seen in a direction parallel with a horizontal plane, wherein a first gap is provided in a middle of the first element portion, and a second gap is provided in a middle of the second element portion, wherein the loop element has a first antenna conductor connected to the feeding portion and a second antenna conductor not connected to the feeding portion, wherein the first gap and the second gap are present between the first antenna conductor and the second antenna conductor, wherein a resonance of the loop element is reconfigurable between a first resonance mode and a second resonance mode, and wherein the first resonance mode is a reverse phase mode in which current flowing through the first antenna conductor is in an opposite direction to current flowing through the second antenna conductor.

2. The antenna according to claim 1, wherein a virtual line passing through the first gap and the second gap is substantially parallel with a virtual plane orthogonal to the horizontal plane, when the antenna is seen in the direction parallel with the horizontal plane.

3. The antenna according to claim 2, wherein the virtual line is substantially orthogonal to a longitudinal direction of at least one of the first element portion and the second element portion.

4. The antenna according to claim 1, wherein the first element portion and the second element portion are substantially parallel with each other.

5. The antenna according to claim 1, wherein the first gap is provided, in the middle of the first element portion, in a longitudinal direction of the first element portion or a direction orthogonal to the longitudinal direction of the first element portion, and the second gap is provided, in the middle of the second element portion, in a longitudinal direction of the second element portion or a direction orthogonal to the longitudinal direction of the second element portion.

6. The antenna according to claim 1, wherein the first element portion and the second element portion are present in a same plane.

7. The antenna according to claim 1, wherein the first element portion is present in a first plane, and the second element portion is present in a second plane substantially parallel with the first plane.

8. The antenna according to claim 7, wherein at least one of the first feeding portion and the second feeding portion is present in a third plane between the first plane and the second plane.

9. The antenna according to claim 8, wherein the third plane is substantially orthogonal to or substantially parallel with at least one of the first plane and the second plane.

10. The antenna according to claim 1, wherein the loop element has an electrical length of approximately one wavelength of a frequency at which the antenna operates.

11. The antenna according to claim 1, wherein the loop element includes a first element between the first feeding portion and the first gap, a second element between the first gap and the second gap, and a third element between the second gap and the second feeding portion, and wherein where an electrical length including both of the first element and the third element is denoted as $L_{e1}$, and an electrical length of the second element is denoted as $L_{e2}$, a ratio ($L_{e1}/L_{e2}$) is equal to or more than 0.6 and equal to or less than 1.4.

12. The antenna according to claim 11, wherein the ratio ($L_{e1}/L_{e2}$) is 0.7 or more and 1.3 or less.

13. The antenna according to claim 11, wherein the ratio ($L_{e1}/L_{e2}$) is 0.8 or more and 1.2 or less.

14. The antenna according to claim 1, wherein a matching circuit including an inductance and a capacitance is provided between the first feeding portion and the second feeding portion.

15. An antenna-attached device comprising:

a substrate; and the antenna according to claim 1 attached to the substrate.

16. An antenna-attached window glass for a vehicle comprising:

a glass plate for a vehicle-use window; and the antenna according to claim 1 attached to the glass plate.

17. The antenna-attached window glass according to claim 16, wherein the glass plate is a windshield.

18. The antenna-attached window glass according to claim 16, wherein the glass plate is attached to a window frame of the vehicle at an angle that is more than 0 degrees and that is equal to or less than 90 degrees with respect to the horizontal plane.

19. The antenna according to claim 1, wherein the antenna is capable of transmitting and receiving electromagnetic waves in a Ultra High Frequency (UHF) band.

20. The antenna according to claim 1, wherein the antenna is capable of transmitting and receiving electromagnetic waves in three bands, including 0.698 GHz to 0.96 GHz, 1.71 GHz to 2.17 GHz, and 2.4 GHz to 2.69 GHz.

* * * * *